US005255063A

United States Patent [19]

Ideyama et al.

[11] Patent Number: 5,255,063

[45] Date of Patent: Oct. 19, 1993

[54] COLOR COPYING APPARATUS WITH IMPROVED START TIMING OF A SCANNER

[75] Inventors: Hiroyuki Ideyama, Toyokawa; Tohru Fujiwara, Tokyo; Kenichi Muroki, Toyokawa; Akito Wada, Toyohashi, all of Japan

[73] Assignee: Minolta Camera Kabushiki Kaisha, Osaka, Japan

[21] Appl. No.: 626,530

[22] Filed: Dec. 12, 1990

[30] Foreign Application Priority Data

Dec. 15, 1989 [JP] Japan ..... 1-326223
Dec. 15, 1989 [JP] Japan ..... 1-326224
Dec. 15, 1989 [JP] Japan ..... 1-326226

[51] Int. Cl.[5] ..... G03G 15/01

[52] U.S. Cl. ..... 355/327; 346/157; 355/208; 355/233

[58] Field of Search ..... 355/208, 228, 232, 233, 355/235, 244, 326, 327; 346/157

[56] References Cited

U.S. PATENT DOCUMENTS 4,320,964 3/1982 Ishida et al. ..... 355/69
4,733,269 3/1988 Kasahara et al. ..... 118/645 X
4,933,721 6/1990 Yasuda et al. ..... 355/210
4,935,787 6/1990 Maeda et al. ..... 355/326
4,965,597 10/1990 Ohigashi et al. ..... 355/327
5,023,708 6/1991 Maruyama et al. ..... 355/327 X

FOREIGN PATENT DOCUMENTS 50-34540 4/1975 Japan .
59-37505 9/1984 Japan .

*Primary Examiner*—Leo P. Picard
*Assistant Examiner*—Christopher Horgan
*Attorney, Agent, or Firm*—Burns, Doane, Swecker & Mathis

[57] ABSTRACT

A color copying apparatus in accordance with the present invention includes: a scanner for scanning an original to form a plurality of electrostatic latent images corresponding to color components of an image of the original; developing devices for converting the electrostatic latent images formed by the scanner to toner images of different colors; a rotating unit on which the toner images obtained by the conversion are superposed; a detector for detecting a rotating position of the rotating unit; a controller for controlling start timing of the scanner in response to a detection output of the detector; and a regulator for regulating the start timing for each of the toner images.

7 Claims, 34 Drawing Sheets

FIG.19

TS SCANNING TABLE

| PAPER SIZE | COPYING MAGNIFICATION | | | | |
|---|---|---|---|---|---|
| | 0.5 | 0.707 | 1.0 | 1.414 | 2.0 |
| A3 LENGTH | 1 | 2 | 2 | 2 | 2 |
| A4 LENGTH | 1 | 2 | 1 | 2 | 2 |
| A4 WIDTH | 1 | 1 | 1 | 1 | 2 |
| A5 LENGTH | 1 | 1 | 1 | 1 | 2 |

COLOR COPYING APPARATUS WITH IMPROVED START TIMING OF A SCANNER

BACKGROUND OF THE INVENTION

1. Field of the Invention

The present invention relates to copying apparatus and particularly to a color copying apparatus for forming a color copy image by superposition of toner images of plural colors.

According to the present invention, it is possible to reduce a size of a rotating unit for superposition of toner images and to increase the number of copies per unit time while maintaining a good precision of superposition of the toner images.

2. Description of the Related Art

An analog type color copying apparatus using a single light source for scanning an original and for exposure to form a latent image on a photoreceptor forms a color copy image corresponding to the original by scanning the same original for a plurality of times, forming toner images of different colors in the respective scanning operations and superposing the toner images of the different colors.

In order to form a toner image in such apparatus, scanning light reflected from an original according to the color of the toner is applied to the photoreceptor by means of a color filter for the corresponding toner color, whereby a latent image of a separated color of the original is formed on the photoreceptor.

In general, toners of three primary colors of cyan (C), magenta (M), and yellow (Y) are used for formation of a color copy image and color separation of scanning light is made by using color filters of red (R), green (G), and blue (B). In cases of forming a black copy image by using a black (BK) toner or forming a monochromatic copy image of a single composite color obtained by combination of the above-mentioned primary color toners, the photoreceptor is exposed to light through a neutral density (ND) filter which regulates an exposure amount.

A conventional color copying apparatus in which a photoreceptor is exposed to scanning light of an original is disclosed for example in Japanese Patent Publication No. 59-37505. Such a conventional color copying apparatus includes a rotating position sensor for detecting a rotating position of a transfer rotating unit driven corresponding to scanning and controls movement of a scanner in response to a rotating position signal generated by the rotating position sensor for each rotation of the transfer rotating unit.

Thus, scanning is started in synchronization with the rotating position signal generated with a prescribed cycle, whereby timing for superposition of respective images on the rotating unit is controlled.

In the case of forming a color copy image, three or four scanning operations are consecutively performed with respect to the same original to form toner images of respective colors.

However, in such a conventional color copying apparatus, scanning is started each time the above-mentioned rotating position signal is generated and if scanning operations are to be performed consecutively, it is necessary to terminate forward and returning movements of the scanner in a cycle of generation of the rotating position signal, that is, in a period of one rotation of the rotating unit. In other words, the cycle of generation of the rotating position signal needs to be longer than the time required for the forward and returning movements of the scanner. In consequence, it is necessary to provide a large-size rotating unit having a large outer surface.

In addition, the time required for reciprocating movements of a scanner differs dependent on a size of an original, a copying magnification, forward or backward scanning in a book division mode, etc. Consequently, if the cycle of generation of the rotating position signal is set corresponding to the copy mode requiring the maximum time for reciprocating movements of the scanner among various copy modes, there is waiting time in a copy mode having a shorter time for reciprocating movements until the next rotating position signal is generated after an end of forward movement and an index or a value indicating the number of copies of an image formed per unit time is lowered.

Further, in the above-mentioned color copying apparatus, an exposure lamp may be turned on at the time of generation of the rotating position signal and counting operation may be performed to measure prescribed time required until a light amount of the exposure lamp attains a prescribed value and becomes stable. In such a case, at the end of the counting operation, forward movement of a scanner (i.e., scanning of the original) is started. Then, at the end of the time of the forward movement of the scanner defined by the size of the original, the copying magnification or the like, the exposure lamp is turned off and the scanner returns.

In such a control of the conventional color copying apparatus, scanning is started after the prescribed time required for the exposure lamp to be stable after the generation of the rotating position signal and, consequently, it sometimes happens that the scanning start timing slightly changes with respect to the timing of generation of the rotating position signal due to an error of the timer counting the prescribed time, or the like.

Thus, the conventional color copying apparatus may involve a disadvantage that a small deviation occurs in superposition of respective toner images, making it difficult to obtain a high-quality color copy image.

SUMMARY OF THE INVENTION

An object of the present invention is to improve a quality of a color image in a color copying apparatus.

Another object of the present invention is to prevent deviation in superposition of toner images in a color copying apparatus.

Still another object of the present invention is to increase the number of copies of a monochromatic copy image per unit time in a color copying apparatus.

A further object of the present invention is to reduce a size of a rotating unit for superposition of toner images while maintaining a good precision of superposition of the toner images in a color copying apparatus.

A further object of the present invention is to increase the number of copies per unit time while maintaining a good precision of superposition of toner images in a color copying apparatus.

In order to accomplish the above-described objects, a color copying apparatus according to an aspect of the present invention includes: a scanner for scanning an original to form a plurality of electrostatic latent images corresponding to color components of an original image; developing means for converting the respective electrostatic latent images formed by the scanner to toner images of different colors; a rotating unit on which the toner images obtained by the conversion are superposed; a detector for detecting a rotating position of the rotating unit; a control device responsive to a detection output of the detector for controlling start timing of the scanner; and a regulator for regulating the start timing for each of the toner images.

The color copying apparatus thus structured has an improved precision for superposition of toner images since the start timing of the scanner is regulated for each of the toner images.

In order to accomplish the above-described objects, a color copying apparatus according to another aspect of the invention is structured as a color copying apparatus operating in first and second modes, including: a scanner for scanning the same original for a plural number of times in the first mode to form a plurality of electrostatic latent images corresponding to color components of an original image, and scanning the original in the second mode to form an electrostatic latent image corresponding to the image of the original; developing means using a plurality of toners of different colors for converting the respective electrostatic latent images formed by the scanner in the first mode using the toners contained therein to toner images of different colors, and converting the electrostatic latent image formed by the scanner in the second mode to a toner image of a single color; a rotating unit on which the toner images obtained by the conversion in the first mode are superposed; a detector for detecting a rotating position of the rotating unit; and a control device for controlling start timing of the scanner for starting operation of the scanner in response to a detection output of the detector in the first mode and starting operation of the scanner independent of the detection output of the detector in the second mode.

The color copying apparatus thus structured starts operation of the scanner independent of the detection output of the detector in the second mode and thus the number of copies per unit time is increased.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 19 is a diagram showing contents of a scanning table according to the embodiment of the invention.

DESCRIPTION OF THE PREFERRED EMBODIMENTS

An embodiment of the present invention will be described with reference to the drawings.

Figure 1:
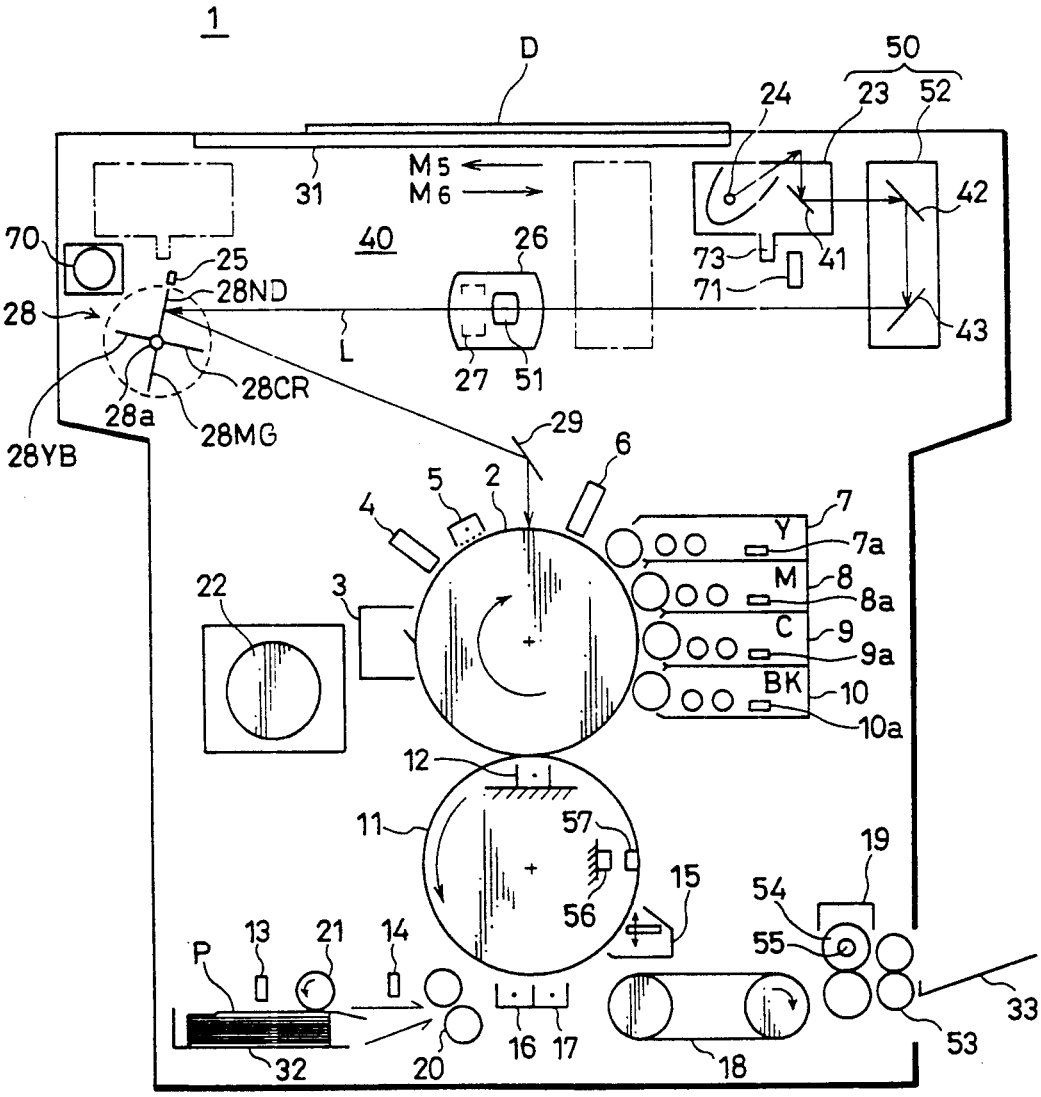
FIG. 1 is a structural sectional view showing a general construction of a color copying apparatus according to an embodiment of the present invention.

FIG. 1 is a sectional front view showing a schematic construction of a color copying apparatus 1.

A photoreceptor drum 2 which is rotatable clockwise is disposed in an almost central portion of a main body of the color copying apparatus. A cleaner unit 3, a main eraser lamp 4, a corona charger 5, an LED array 4 as a partial eraser, developing devices 7 to 10, and a transfer belt 11 as an intermediate transfer medium are disposed around the photoreceptor drum 2. The photoreceptor drum 2 has its surface provided with a photoconductive layer. When the photoreceptor drum 2 passes by the main eraser lamp 4 and the corona charger 5, the surface thereof is uniformly charged and receives light from an optical system 40 to be described afterwards so as to form a latent image.

The developing devices 7, 8, 9, 10 contain toners of colors of yellow (Y), magenta (M), cyan (C), and black (BK), and toner emptiness sensors 7*a*, 8*a*, 9*a*, 10*a* are provided in those developing devices to detect lack of toners of those colors.

The developing devices 7 to 10 are not limited to a type fixed near the photoreceptor drum 2. For example, the developing devices 7 to 10 may be integrally formed so as to be movable vertically, or may be of any other type insofar as they can selectively supply toners of different colors to the photoreceptor drum 2.

The transfer belt 11 temporarily holds toner images developed on the photoreceptor drum 2 by means of the developing devices 7 to 10 so as to transfer (secondarily transfer) those toner images on a sheet of paper P where a copy image is to be formed. The transfer belt 11 is put on a plurality of rollers (not shown) and is rotatably supported counterclockwise always in contact with the photoreceptor drum 2.

A transfer charger 12 for primarily transferring a toner image from the photoreceptor drum 2, and a rotating position sensor 56 for detecting a rotating position of the transfer belt 11 are fixed inside the transfer belt 11. The rotating position sensor 56 is formed by a photo sensor which generates a rotating position signal S10 when it detects reflected light from a belt mark 57 provided in a portion of the inner surface of the transfer belt 11.

A transfer charger 16 for secondarily transferring a toner image onto the paper P, a separation charger 17 for separating the paper P from the transfer belt 11, and a belt cleaner 15 for cleaning the outer surface of the transfer belt 11 are disposed outside the transfer belt 11. The belt cleaner 15 can be selectively pressed against the transfer belt 11 (at the time of cleaning) or separated therefrom.

The optical system 40 is disposed in an upper portion of the color copying apparatus 1. The optical system 40 includes: a scanner 50 located under a glass platen 31 and reciprocating in directions of the arrow M5 (for forward movement) and the arrow M6 (for returning movement); a main lens 26 as well as a CCD 27 for color edition and a lens 51 in proximity thereto; a filter selecting mechanism 28 enabling color separation exposure; a fixed mirror 29 and the like. Thus, the optical system 40 scans an original D at the time of forward movement of the scanner 50 and the photoreceptor drum 2 is exposed to the scanning light.

The scanner 50 includes a first slider 23 having an exposure lamp 24 and a mirror 41, and a second slider 52 having mirrors 42 and 43. At the time of scanning the original D, a scanning motor 70 drives the first and second sliders 23 and 52 to move forward the first slider 23 at a speed of v/n (n being a copying magnification) with respect to a rotating speed v of the photoreceptor drum 2 and to move forward the second slider 52 at a speed of v/2n. A scanner home switch 71 includes a photo sensor and provides a signal indicating that the scanner 50 is returned at a reference position (home position) when a projecting portion 73 of the first slider 23 becomes opposite to the scanner home switch 71.

The filter selecting mechanism 28 includes a mirror 28ND for full reflection of light, and three filter mirrors 28YB, 28MG, 28CR which are arranged radially around a shaft 28*a* with angles of 90° from one another. When the shaft 28*a* rotates to be in a predetermined position, any of those mirrors is selected and scanning light L is applied to an exposure point on the photoreceptor drum 2 through the fixed mirror 29 by using the selected mirror. A mirror reference position sensor 25 is disposed in a position where the selected mirror is located. In FIG. 1, a state where the mirror 28ND is selected and located is shown.

The filter mirrors 28YB, 28MG, 28CR are integrally formed by combinations of color separation filters of blue (B), green (G) and red (R) and mirrors, and they are used corresponding to toners of Y, M and C.

A paper cassette 32 containing paper P is set in a lower left portion of the color copying apparatus 1 and an outlet tray 33 containing paper P where a copy image has been formed is provided in a lower right portion thereof.

Sheets of paper P are fed one by one from the paper cassette 32 by means of a paper feed roller 21 and each sheet of paper is transported by a timing roller 20 in synchronization with the transfer belt 11, whereby it is sent to a fixing unit 19 by means of a transport belt 18 after a toner image is secondarily transferred from the transfer belt 11 onto the paper P. A paper size sensor 13 for detecting a size of paper P is disposed near the paper feed roller 21 and a timing sensor 14 for detecting a leading edge position of passing paper P is provided near the timing roller 20.

The fixing unit 19 includes a fixing roller 54 and a fixing heater lamp 55 for heating, etc. and it melts a toner image and fixes the image on the paper P. The paper P on which the copy image is formed by the fixation of the toner image is discharged onto the outlet tray 33 by means of a discharge roller 53.

A main motor 22 is disposed in a left central portion of the color copying apparatus 1. The main motor 22 drives the above-mentioned photoreceptor drum 2, transfer belt 11, paper feed roller 21, timing roller 20, transport belt 18, fixing roller 54, and discharge roller 53 etc.

In the color copying apparatus 1 thus structured, it is possible to form a monochromatic copy image of a single toner color of each of the above-mentioned colors Y, M, C and BK, a composite monochromatic copy image of R (Y and M), G (Y and C) or B (M and C) obtained by superposing toner images of two colors out of the three primary colors Y, M and C, and a color (full color) copy image obtained by superposing toner images of the three primary colors.

In order to form a monochromatic or composite monochromatic copy image, the original D is exposed to scanning by using the mirror 28ND and a latent image formed on the photoreceptor drum 2 is developed by using one of the developing devices 7 to 10 corresponding to the designated color, whereby the toner image is transferred onto the transfer belt 11. In the case of forming the composite monochromatic copy image, the same original D is exposed again to scanning by using the mirror 28ND and the toner image developed by using another one of the developing devices 7 to 10 is transferred onto the transfer belt 11, whereby the toner images of the two colors are superposed on the transfer belt 11.

In order to form a color copy image, the original D is scanned a plural number of times according to a well-known color electrophotographic process and selective switching is made among the filter mirrors 28YB, 28MG and 28CR, and among the developing devices 7 to 9 for each scanning so that a latent image of a separated color of the original D is formed and developed. The toner images thus obtained are successively transferred onto the transfer belt 11 so as to be superposed thereon and thus the color copy image is formed.

In superposition of toner images (referred to hereinafter as multiplex transfer), it is necessary to transfer each toner image in the same position on the transfer belt 11 and, accordingly, in the color copying apparatus 1 of the present embodiment, start timing for moving the scanner 50 with reference to timing of generation of the rotating position signal S10 from the above-mentioned rotating position sensor 56, that is, start timing for forming each latent image on the photoreceptor drum 2 is controlled.

Figure 20:
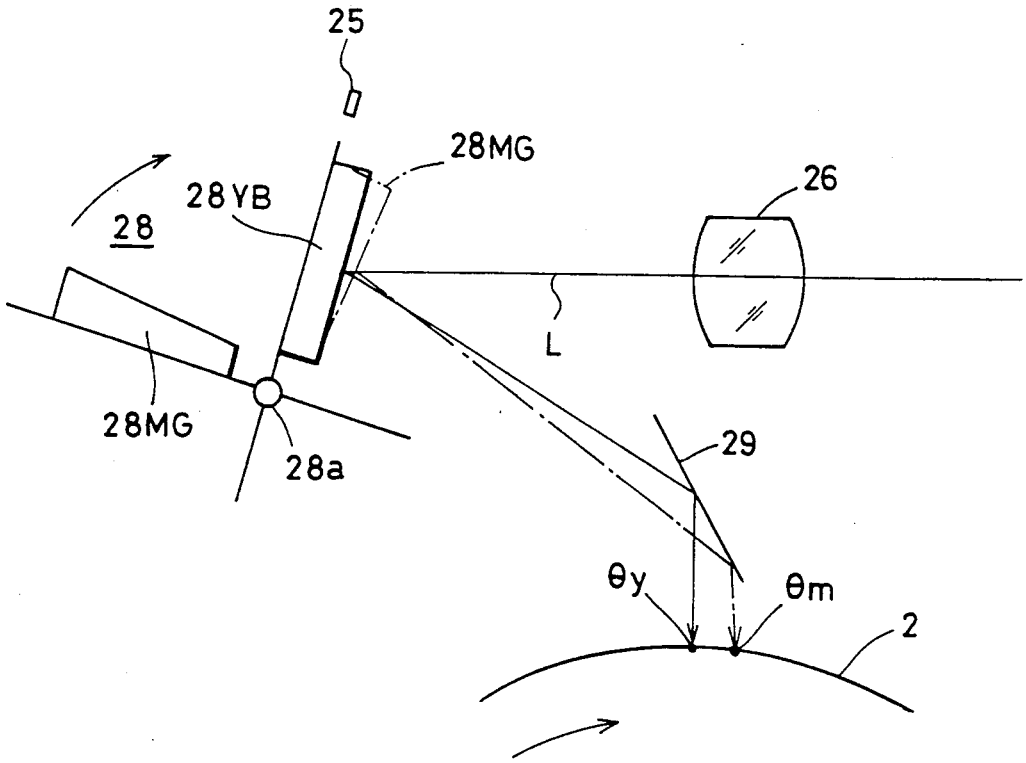
FIG. 20 is a diagram showing exposure conditions of a photoreceptor drum according to the embodiment of the invention.

FIG. 20 shows exposure conditions of the photoreceptor drum 2.

In the color copying apparatus 1, in order to simplify the optical system 40, the filter selecting mechanism 28 is formed by the filter mirrors 28YB, 28MG, 28CR integrally combined with mirrors and color separation filters so that the mirrors defining the optical paths of the scanning light L are movable.

As a result, deviation might occur in the exposure point on the photoreceptor drum 2 among the four mirrors 28YB, 28MG, 28CR, 28ND due to unevenness in precision of attachment of the filter mirrors 28YB, 28MG, 28CR to the support or due to variation in stop positions (stop angles) of the selected filter mirrors 28YB, 28MG, 28CR and the mirror 28ND.

FIG. 20 shows the respective exposure points Θy and Θm of the filter mirrors 28YB and 28MG, respectively, by way of example.

In case where deviation in the exposure point occurs, the transfer positions of the respective toner images on the transfer belt 11 become different assuming that the start timing for each scanning in response to the rotating position signal S10 is the same, and color deviation occurs in the copy image, thereby lowering the quality of the image.

In order to prevent such phenomenon in the color copying apparatus 1, the scanning start timing in response to the rotating position signal S10 is adjustable for each of the mirrors 28Yb, 28MG, 28CR and 28ND.

In the following description, the mirror 28ND and the filter mirrors 28YB, 28MG, 28CR are also called an ND filter, a B filter, a G filter and an R filter taking account of color separation characteristics.

Figure 2:
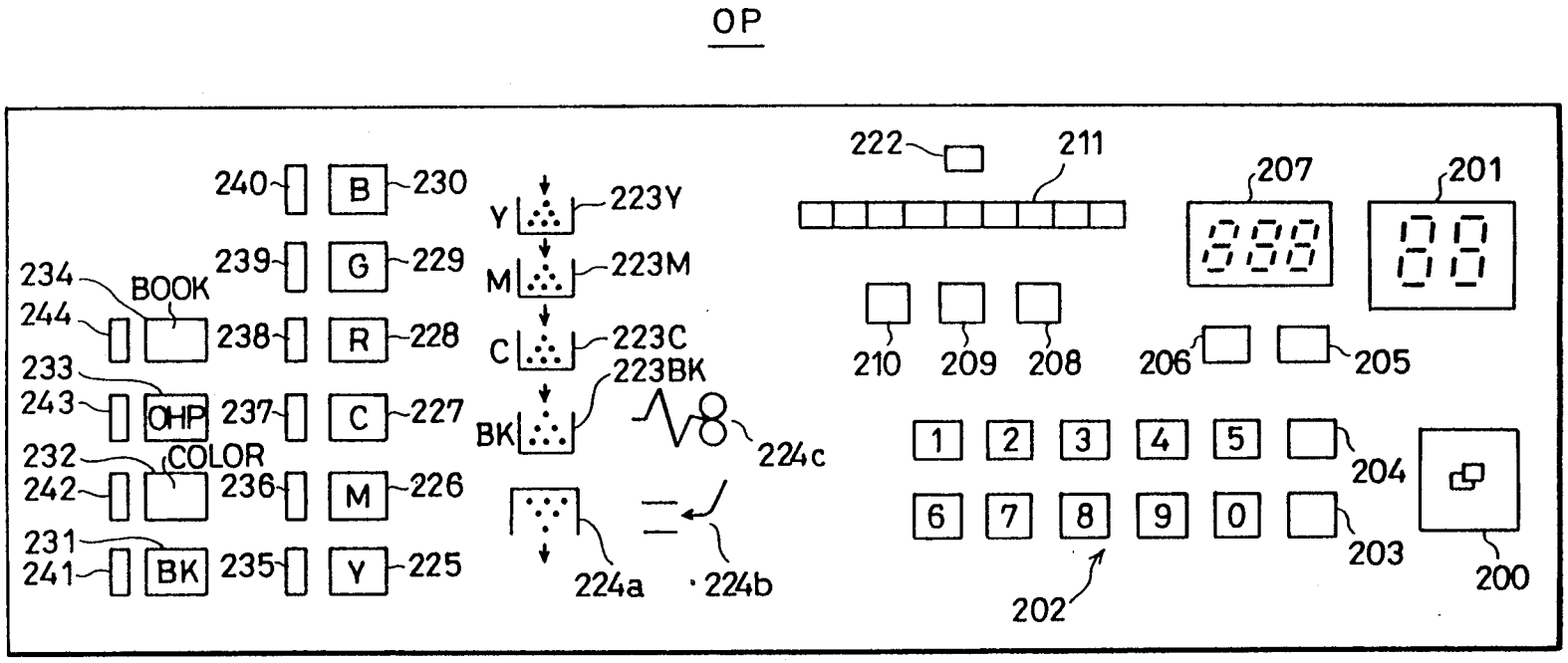
FIG. 2 is a plan view of a scanning panel provided on an upper surface of the color copying apparatus of FIG. 1.

FIG. 2 is a plan view of an operation panel OP provided on the upper surface of the color copying apparatus 1.

A right portion of the operation panel OP includes keys and LED displays used in normal copy operation, such as: a print key 200 for starting copy operation; ten-key pad 202 for setting copy conditions such as the number of copies; 7-segment LED display 201 for displaying the number of copies; a clear stop key 203; an interruption key 204; magnification up and down keys 205 and 206 for setting the copying magnification; a 3-digit 7-segment LED display 207 for displaying the copying magnification; up and down keys 210 and 208 for manually setting densities of a copy image by steps; an LED display 211 for displaying a density level of a copy image; an automatic density setting key 209; and an automatic density indication LED 222. A left portion of the operation panel OP includes: LED displays 223Y, 223M, 223C and 223BK for displaying lack of toners of the respective colors Y, M, C and BK; an LED display **224*a* for displaying a full state of a container of waste toner; an LED display 224*b* for indicating interruption; an LED display 224*c* for indicating paper jam; color keys 225 to 231 corresponding to the respective colors (Y, M, C, R, G, B and BK) for designating a color for a monochromatic copy image; a full color key 232 for designating color copy; an OHP key 233 for designating a mode where a transparent sheet or the like for an overhead projector (OHP) is used as paper P; a book key 234 for designating a mode where the right and left pages of an opened book or the like are copied by dividing those pages into two sheets of paper P; and LEDs 235 to 244 for display corresponding to the respective keys 225 to 234**, respectively.

In the following description, the color keys 225, 226, 227, 228, 229, 230 and 231 are also referred to as Y key, M key, C key, R key, G key, B key, and BK key, respectively.

Figure 3:
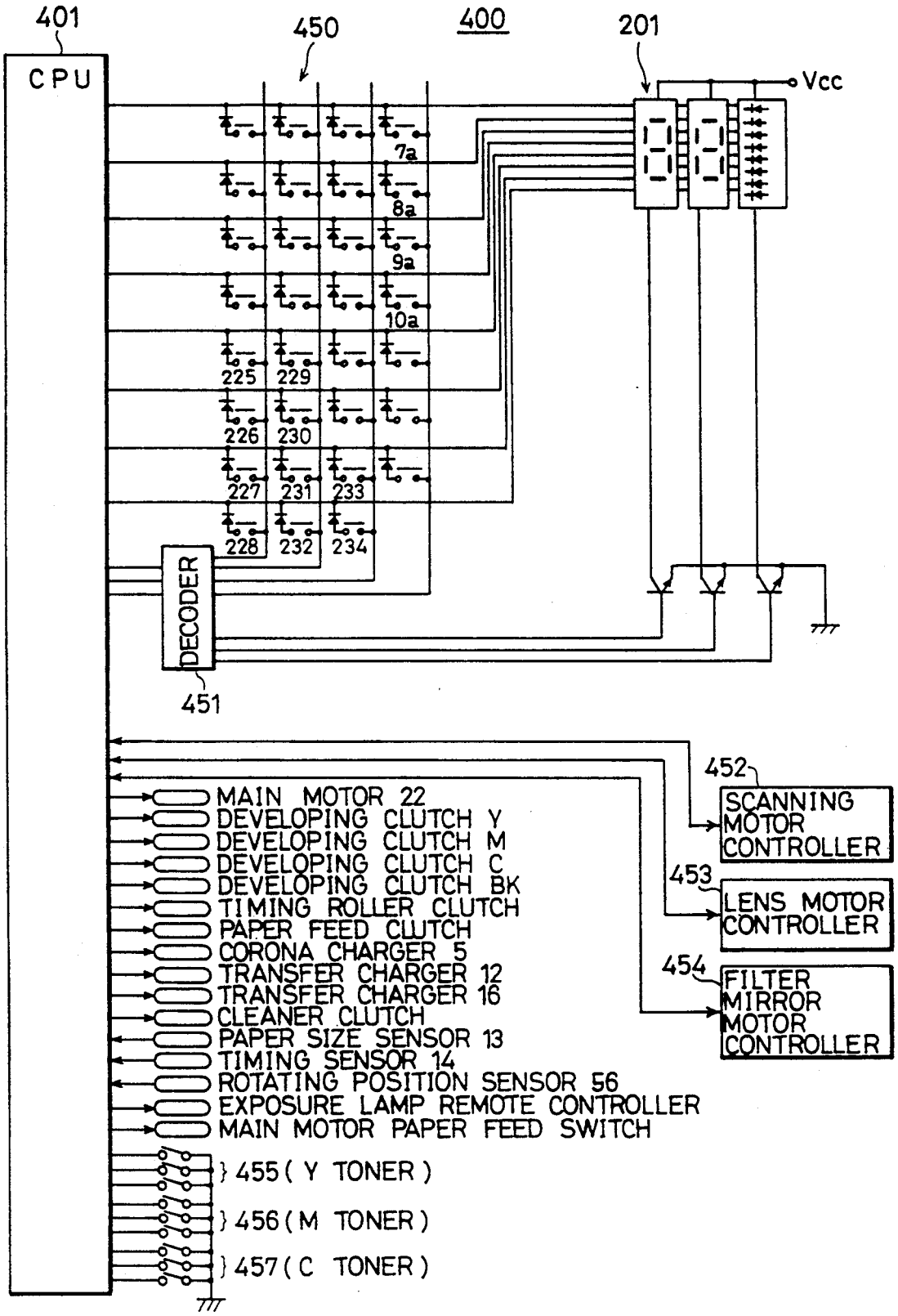
FIG. 3 is a block diagram of a control unit of the color copying apparatus of FIG. 1.

FIG. 3 is a block diagram of the control circuit 400 of the color copying apparatus 1.

The control circuit 400 includes: a central processing unit (CPU) 401 for controlling entire operation of the copying apparatus 1; a scanning motor controller 452 for controlling drive of the scanner 50; a lens motor controller 453 for controlling movement of the main lens 26 according to the copying magnification; and a filter mirror motor controller 454 for controlling switching of the filter selecting mechanism 28.

The CPU 401 is connected with a switch matrix 450 including various operation keys on the operation panel OP, toner emptiness sensors **7*a* to 10*a* and the like arranged in vertical and horizontal directions. The 7-segment LED display 201 and the LED displays related with designation of operation modes and colors are connected to the CPU 401 through the switch matrix 450 and a decoder 451**, whereby the turn-on and turn-off of those displays are controlled.

Input terminals of the CPU 401 receive output signals of the paper size sensor 13 and the timing sensor 14 and the rotating position signal S10 and, in response to those signals and signals from the switch matrix 450, the CPU 401 controls on/off operations of the main motor 22, various clutches such as developing clutches, the chargers, the exposure lamp 24 etc. connected to output terminals of the CPU 401.

The CPU 401 is further connected with 3-line dip switches 455, 456 and 457 for compensating for the above-mentioned deviation in the exposure points at the time of selectively switching among the B filter, G filter and R filter. Thus, the scanning start timing for forming respective toner images of Y, M and C can be set variably by eight steps with respect to the timing of generation of the rotating position signal S10.

Thus, in the color copying apparatus 1, correction can be made so that the exposure points related with the B filter, G filter and R filter can be coincident with the exposure point related with the ND filter as a reference, and it is possible to form a color copy image of high quality without any color deviation.

Next, referring to flow charts of FIGS. 4 to 18, operation of the color copying apparatus 1 will be described.

Figure 4:
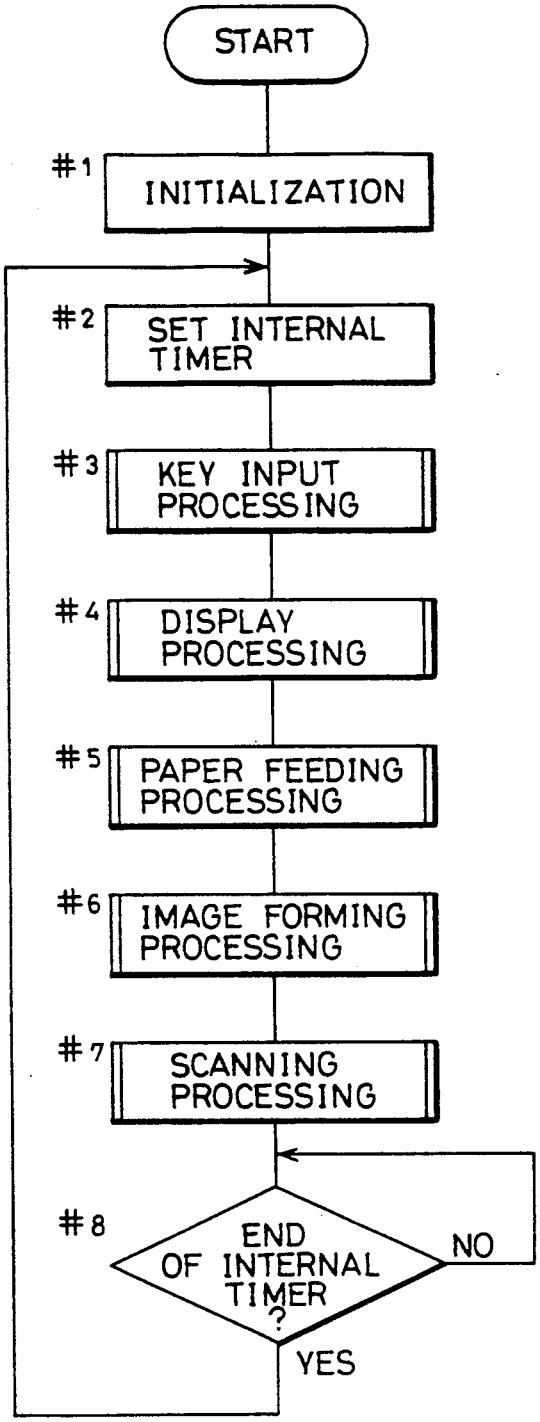
FIG. 4 is a flow chart showing a main routine of the CPU shown in FIG. 3.

FIG. 4 is a main flow chart schematically showing operation of the CPU 401.

When the program starts by turn-on of power supply, superposes and peripheral interfaces are initialized in step #1 and an internal timer for defining a cycle of one routine of the CPU 401 is set in step #2.

In step #3, key input processing for accepting signals from the operation keys of the operation panel OP is performed and, in step #4, display processing for displaying data on the operation panel OP is performed.

Then, control is made to perform copy sequence processing including paper feeding processing (step #5) for controlling feeding and transport of paper P, image forming processing (step #6) in an electrophotographic process, and scanning processing (step #7) for scanning the original D.

After those sequential processing operations, there is a wait in step #8 until the internal timer comes to a prescribed end, and then the program returns to step #2. Thus, the cycle of one routine is maintained constant and while the power supply is on, the processing operations in steps #2 to #8 are repeated.

Figure 5:
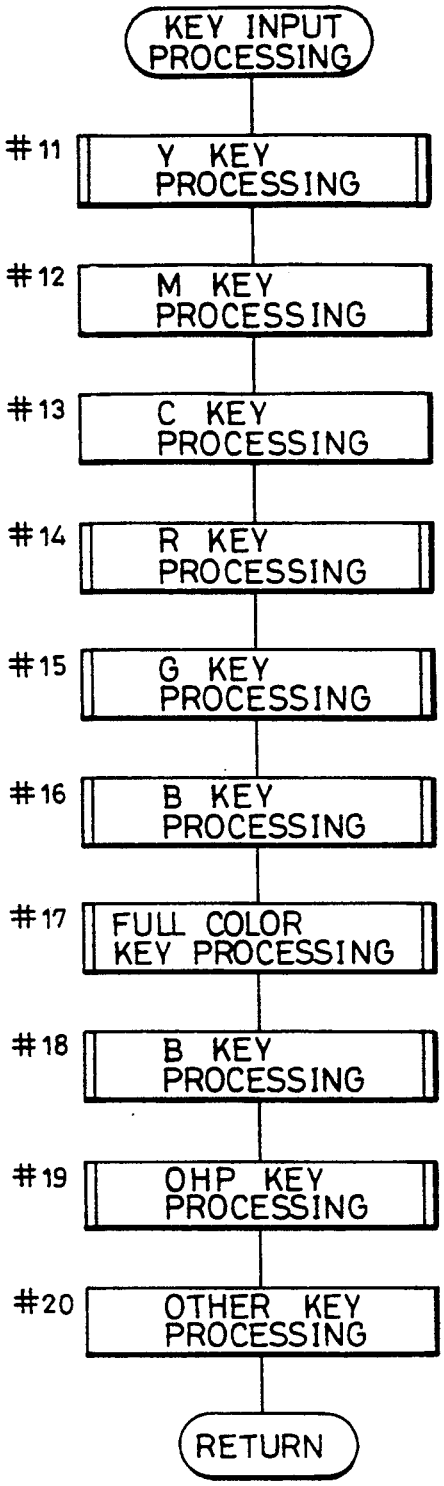
FIG. 5 is a flow chart showing specific procedure of the key input processing routine in FIG. 4.

FIG. 5 is a flow chart of the key input processing in step #3 of FIG. 4.

Steps #11 to #18 are related with key processing operations corresponding to the operation keys for designating the respective colors of a copy image, in which monochromatic modes of single toner colors of Y, M, C, composite monochromatic modes of R, G, B, the full color mode, and the BK monochromatic mode (corresponding to black-and-white copy) are set respectively.

In step #19, the OHP key processing is performed and in step #20, other key processing is performed.

Figure 6:
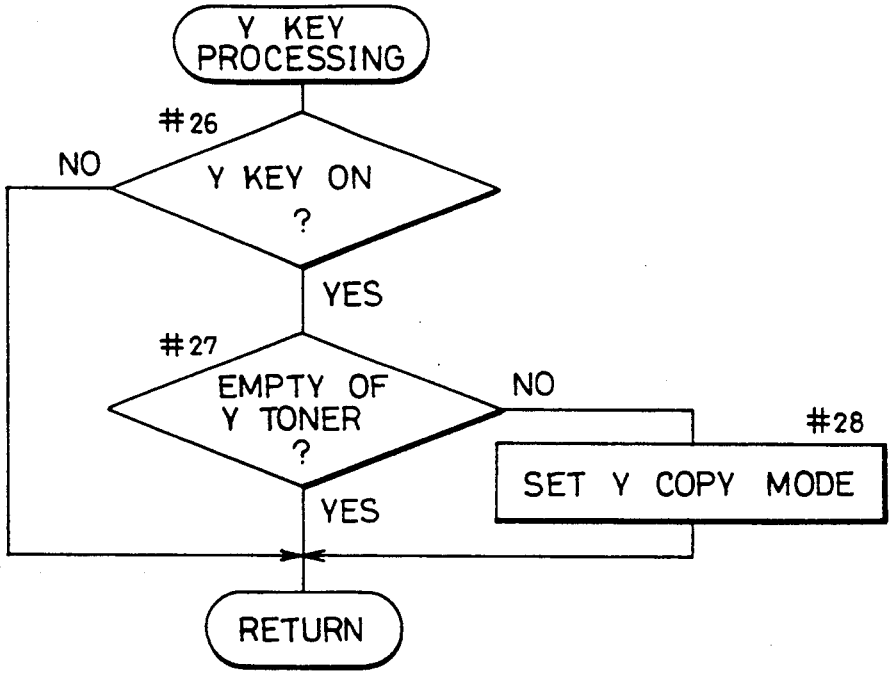
FIG. 6 is a flow chart showing specific procedure of the Y key processing in FIG. 5.

FIG. 6 is a flow chart of the Y key processing in step #11 of FIG. 5.

First, in step #26, it is determined whether the Y key 225 is on or not. If NO, the program returns.

If YES in step #26, emptiness checking is performed in step #27 to determine whether the developing device is empty of Y toner or not (that is, whether Y toner is lacking or not). If YES, the program returns. If NO in step #27, that is, if Y toner exists, the Y copy mode for monochromatic copy using only Y toner is set in step #28.

Though not shown, determination as to turn-on of the color key of the corresponding color and determination as to emptiness of toner are also performed in the M key processing and C key processing in steps #12 and #13 in FIG. 5 in the same manner as in the Y key processing, and if the conditions are satisfied, the M copy mode or the Y copy mode is set.

Figure 7:
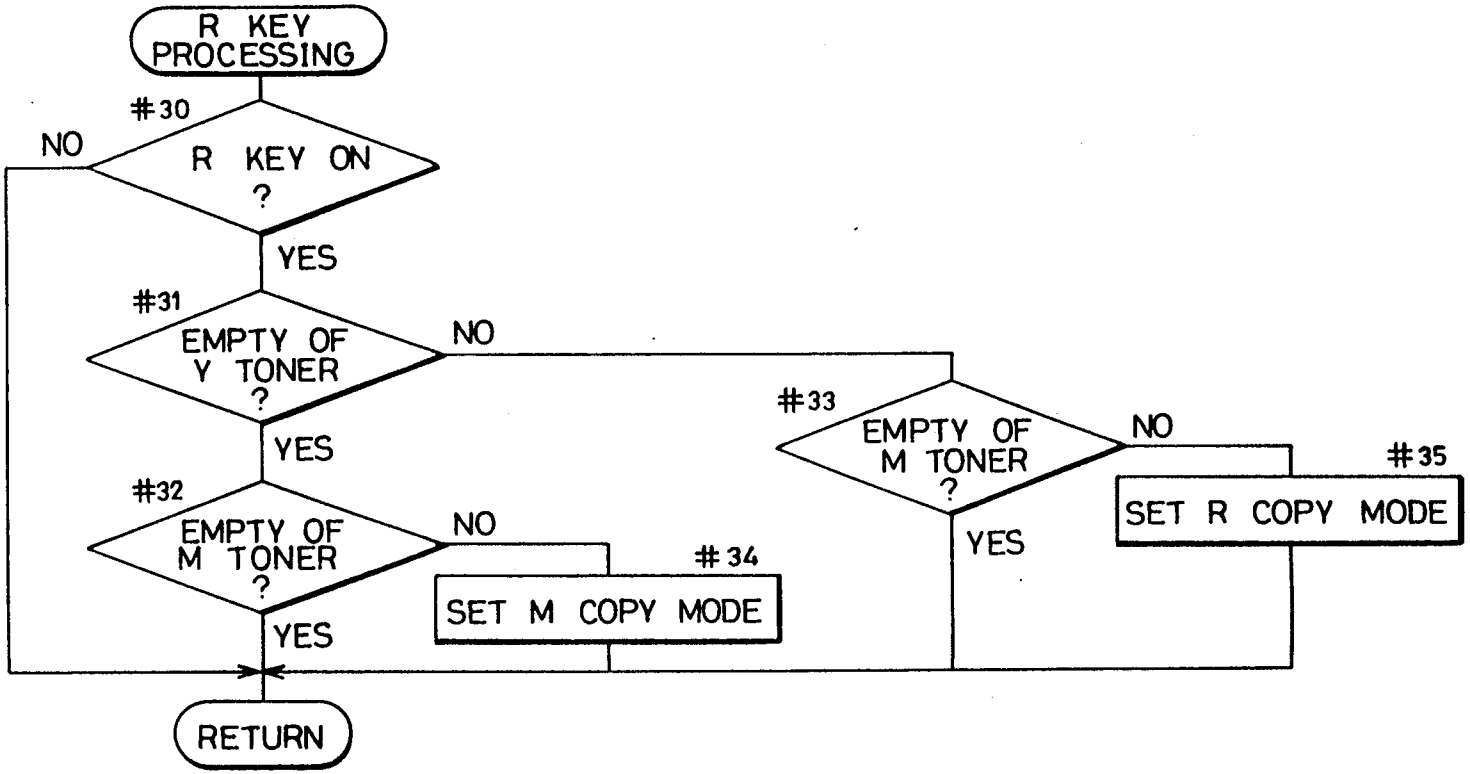
FIG. 7 is a flow chart showing specific procedure of the R key processing in FIG. 5.

FIG. 7 is a flow chart of the R key processing in step #14 of FIG. 5.

First, in step #30, it is determined whether the R key is on or not, and if YES, it is determined in step #31 whether the developing device is empty of Y toner.

If Y toner exists, it is determined in step #33 whether the corresponding developing device is empty of M toner. If both Y toner and M toner exist, the R copy mode for superposing the Y toner image and M toner image is set in step #35.

On the other hand, if it is determined in step #31 that the corresponding developing device is empty of Y toner, it is also determined in step #32 that the corresponding device is empty of M toner, and if M toner exists although Y toner does not exist, the M copy mode for monochromatic copy using only M toner is set in step #34.

This is for the following reason. Since R and M are visually similar colors, even if it is not possible to give the color of R because of lack of Y toner, the M copy mode is set as a substitute of the R copy mode, taking account of the turn-on for the R key. If both Y toner and M toner are lacking, no copy mode is set although the R key is turned on.

Figure 8:
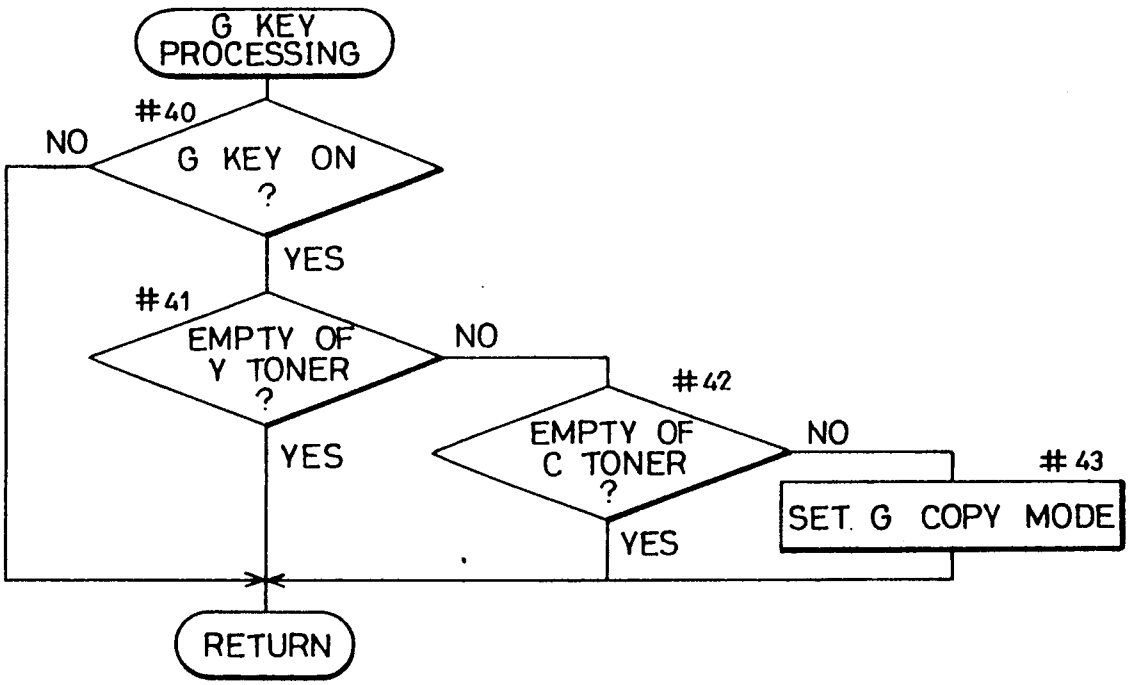
FIG. 8 is a flow chart showing specific procedure of the G key processing in FIG. 5.

FIG. 8 is a flow chart of the G key processing in step #15 of FIG. 5.

First, in step #40, it is determined whether the G key is on or not. If YES, checking for emptiness of Y toner is performed in step #41.

If Y toner exists, checking for emptiness of C toner is performed in step #42. If both Y toner and C toner exist, the G copy mode for superposing the Y toner image and C toner image is set in step #43.

If YES in steps #40 and #41, the program returns without setting any copy mode.

Since G and Y, or G and C are generally not regarded as similar colors, the single color of Y or C cannot be used as a substitute for G. Consequently, if either Y toner or C toner is lacking, neither color copy mode is set.

Figure 9:
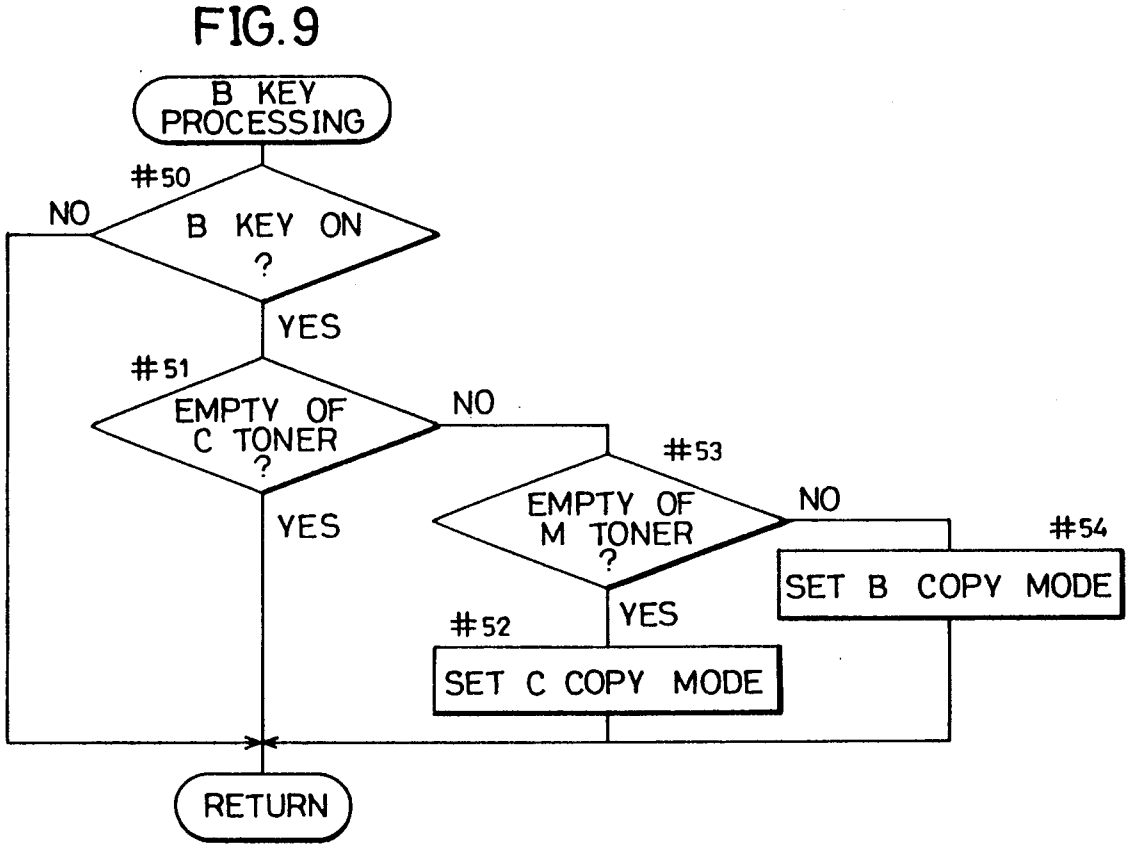
FIG. 9 is a flow chart showing specific procedure of the B key processing in FIG. 5.

FIG. 9 is a flow chart of the B key processing in step #16 of FIG. 5.

First, in step #50, it is determined whether the B key is on or not. If YES, checking for emptiness of C toner is performed in step #51.

If C toner exists, checking for emptiness of M toner is performed in step #52. If both C toner and M toner exist, the B copy mode for superposing the C toner image and M toner image is set in step #54.

If YES in step #52, that is, if C toner exists and M toner does not exist, the C copy mode for monochromatic copy using only C toner is set in step #53.

Thus, since B and C are visually similar colors, even if it is not possible to give the color of B because of lack of M toner, the C copy mode is set as a substitute for the B copy mode taking account of the turn-on of the B key.

Figure 10:
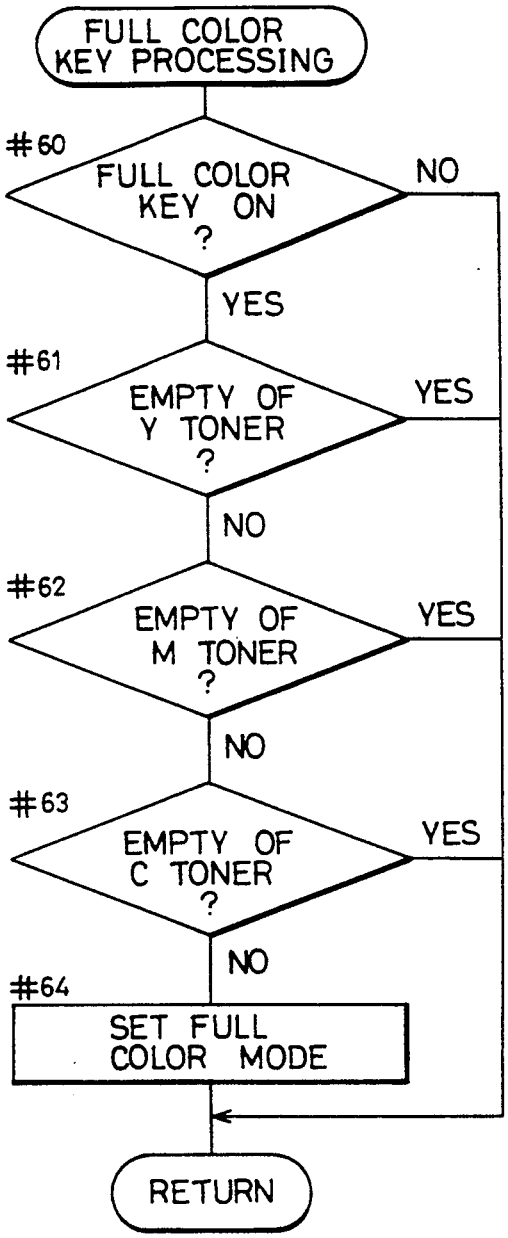
FIG. 10 is a flow chart showing specific procedure of the full color key processing in FIG. 5.

FIG. 10 is a flow chart of the full color key processing in step #17 of FIG. 5.

First, in step #60, it is determined whether the full color key 232 is on or not. If YES, checking for emptiness of toners of Y, M and C is performed successively in steps #61 to #63.

If all the Y, M and C toners exist, the full color mode for superposing the toner images of Y, M and C is set in step #64.

If one of the Y, M and C toners is lacking, it is not possible to form a color copy image and therefore the program returns without setting the full color mode.

Figure 11:
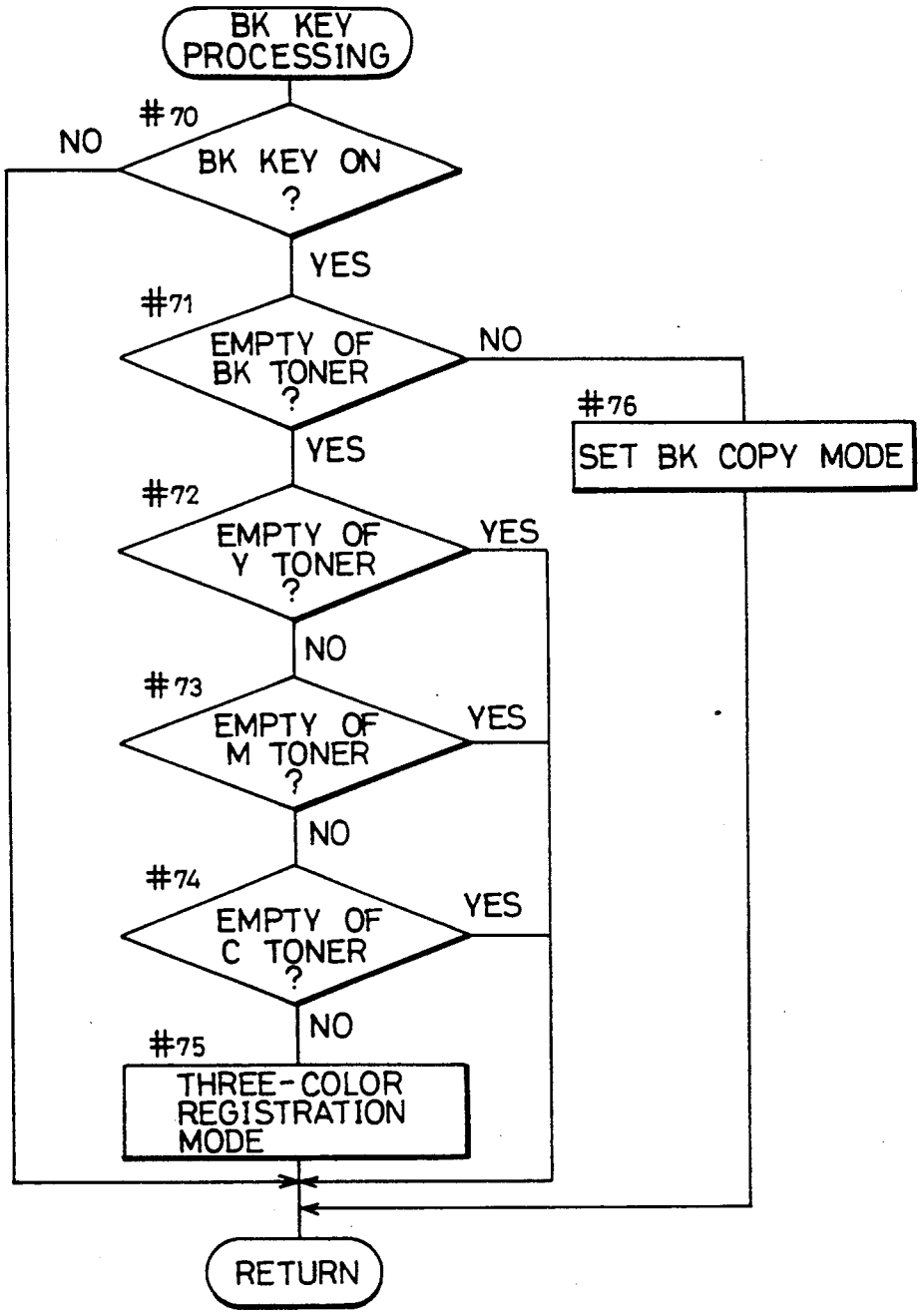
FIG. 11 is a flow chart showing specific procedure of the BK key processing in FIG. 5.

FIG. 11 is a flow chart of the BK key processing in step #18 of FIG. 5.

First, in step #70, it is determined whether the BK key is on or not and if YES, checking for emptiness of BK toner is performed in step #71 to determine whether the developing device is empty of BK toner.

If BK toner exists, the BK copy mode for monochromatic copy using only BK toner is set in step #76.

On the other hand, if YES in step #71, checking for emptiness of Y, M and C toners is performed successively in steps #72 to #74.

If all Y, M and C toners exist, a three-color superposition mode for superposing the Y, M and C toner images formed successively by using the mirror 28ND is set in step #75.

Thus, in the color copying apparatus 1, if BK toner prepared mainly for forming a black-and-white copy image is lacking apart from the toners of the three primary colors for forming a color copy image, a black-and-white copy image is formed by using the toners of the three primary colors as substitutes without forbidding black-and-white copy.

Figure 12:
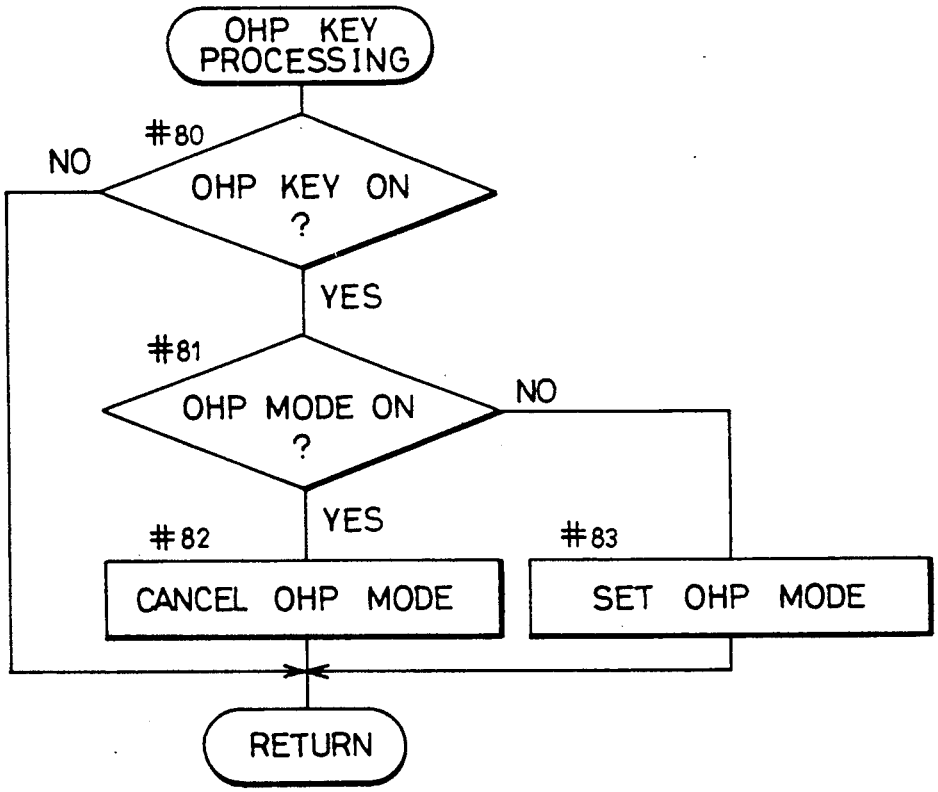
FIG. 12 is a flow chart showing specific procedure of the overhead projector (OHP) key processing in FIG. 5.

FIG. 12 is a flow chart of the OHP key processing in step #19 of FIG. 5.

First, in step #80, it is determined whether the OHP key 233 is on or not. If YES in step #80, it is determined in step #81 whether the OHP mode is already set or not.

If YES in step #81, the OHP mode is canceled in step #82. If NO in step #81, the OHP mode is set in step #83.

The OHP mode is an operation mode in which the processing speed in the entire electrophotographic process is slower than that in the normal operation mode. In this OHP mode, the time for paper P to pass through the fixing unit 19 can be made long and a plurality of superposed toner images can be fully melted and mixed, making it possible to enhance light transmittance of the color copy image.

The color copying apparatus 1 of the present embodiment includes a timer for measuring prescribed time in return from the OHP mode to the normal operation mode so as to start operation by an electrophotographic process only after the respective components related with the electrophotographic process are in stable state. Consequently, it is possible to avoid disturbance in a copy image due to defective cleaning or defective agitation of toner, or to avoid automatic stop of processing due to defective detection.

Figure 13:
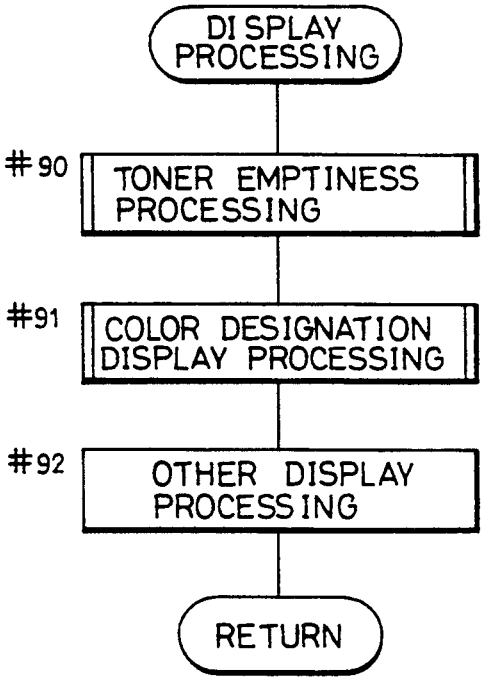
FIG. 13 is a flow chart showing specific procedure of the display processing in FIG. 4.

FIG. 13 is a flow chart of the display processing in step #4 of FIG. 4.

In step #90, toner emptiness processing for displaying lack of each toner on the operation panel OP is performed in response to signals from the toner emptiness sensors 7a to 10a. In step #91, color designation display processing for display corresponding to the designated color of a copy image is performed.

After those processing operations, other display processing is performed in step #92.

Figure 14:
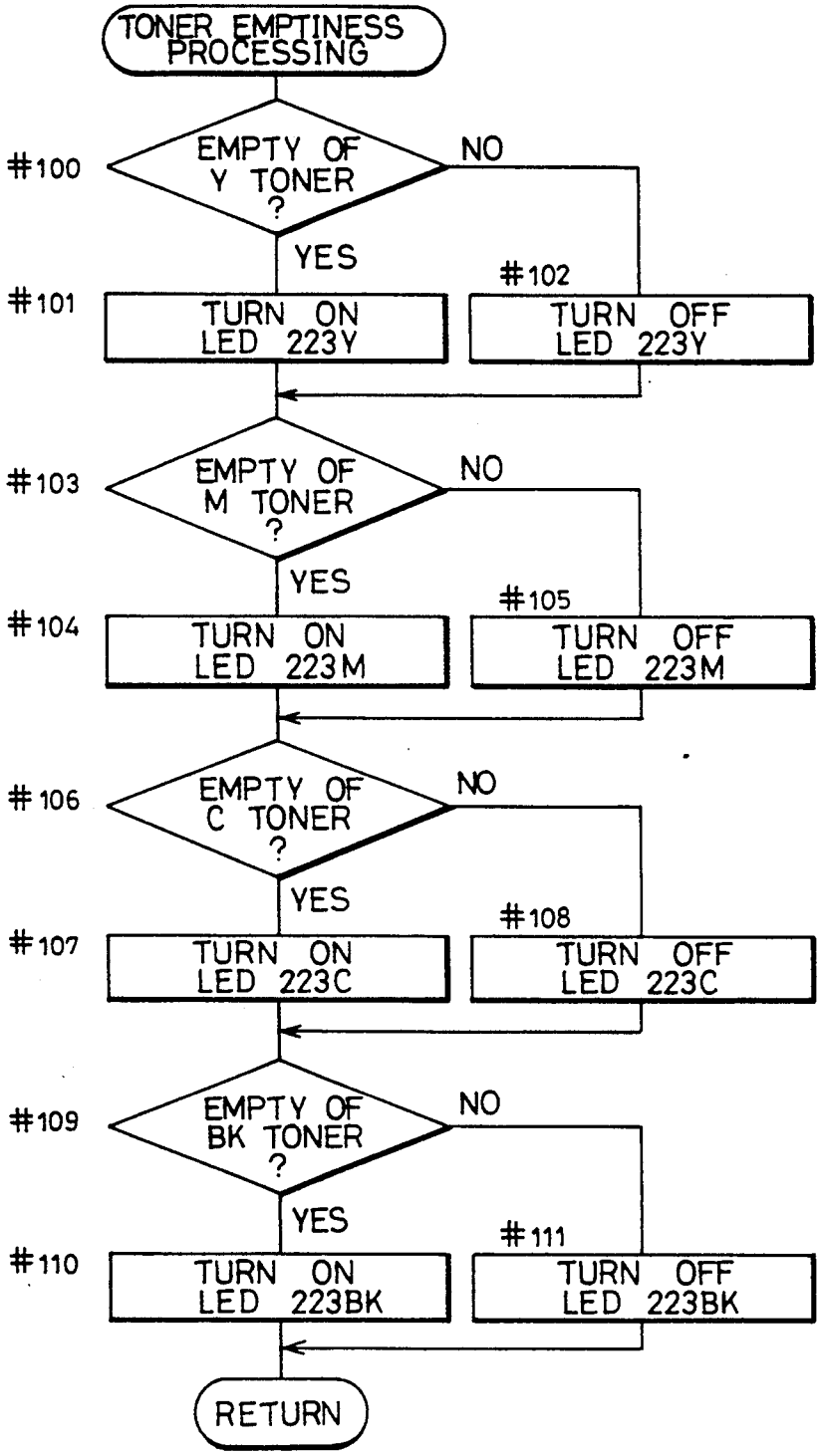
FIG. 14 is a flow chart showing specific procedure of the toner emptiness processing in FIG. 13.

FIG. 14 is a flow chart of the toner emptiness processing in step #90 of FIG. 13.

First, in step #100, it is determined whether the corresponding device is empty of Y toner. If YES in step #100, the LED display 223Y is turned on in step #101. If NO in step #100, the LED display 223Y is turned off in step #102.

Similarly, in step #103, it is determined whether the corresponding device is empty of M toner. If YES, the LED display 223M is turned on in step #104. If NO in step #103, the LED display 223M is turned off in step #105.

Subsequently, in step #106, it is determined whether the corresponding device is empty of C toner. If YES, the LED display 223C is turned on in step #107. If NO in step #106, the LED display 223C is turned off in step #108.

Finally, in step #109, it is determined whether the corresponding device is empty of BK toner. If YES, the LED display 223BK is turned on in step #110. If NO in step #109, the LED display 223BK is turned off in step #111.

Figure 15A:
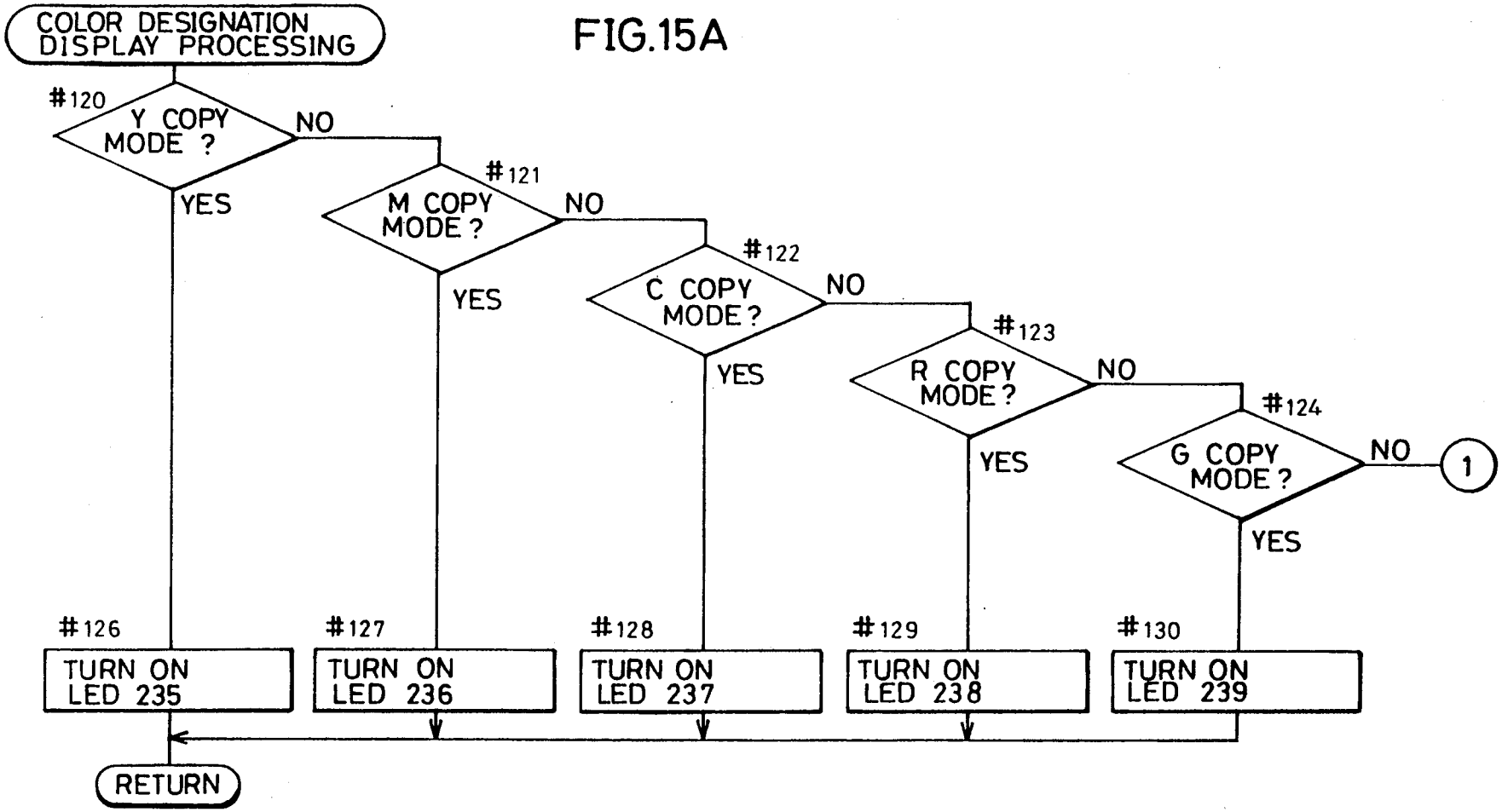
FIGS. 15A and 15B are flow charts showing specific procedures of the color designation display processing in FIG. 13.
Figure 15B:
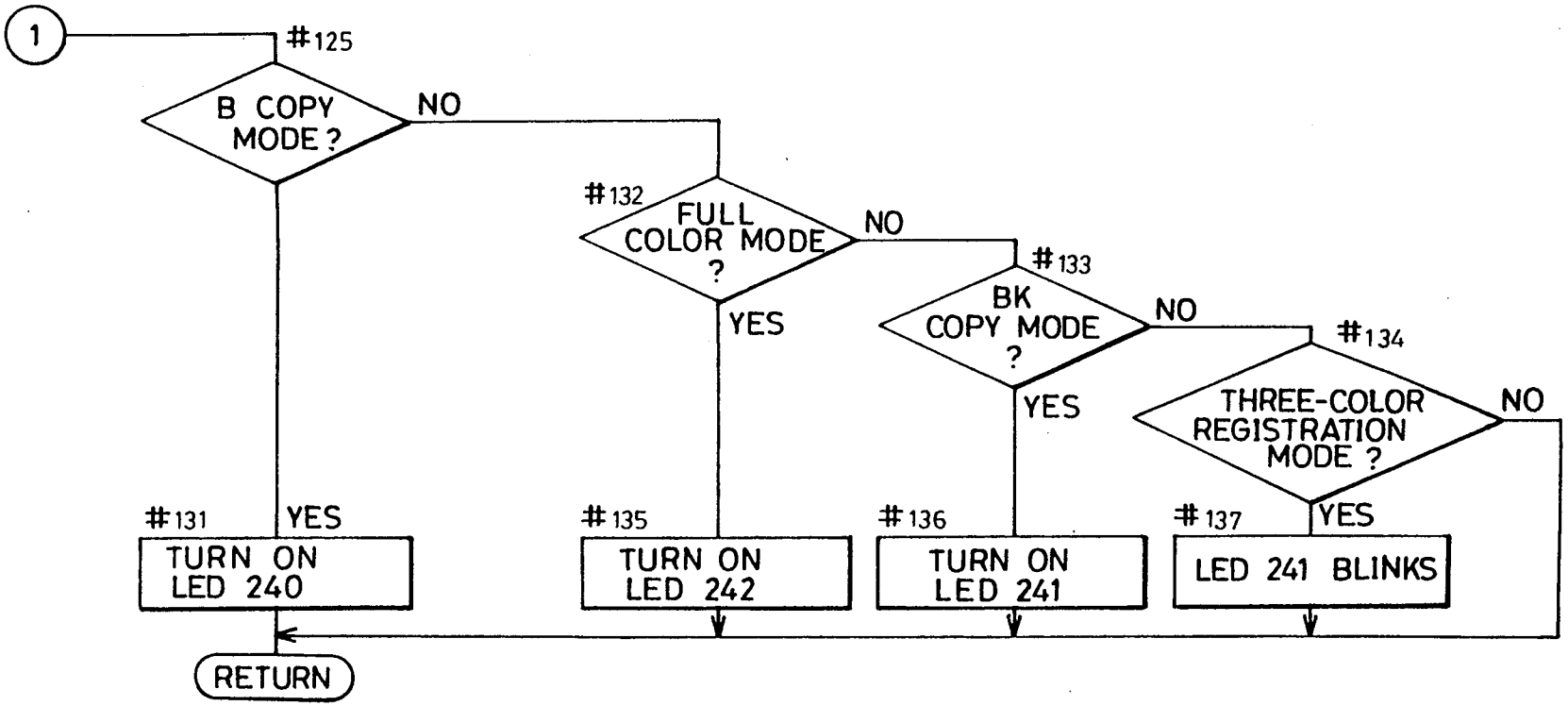
Figure 16A:
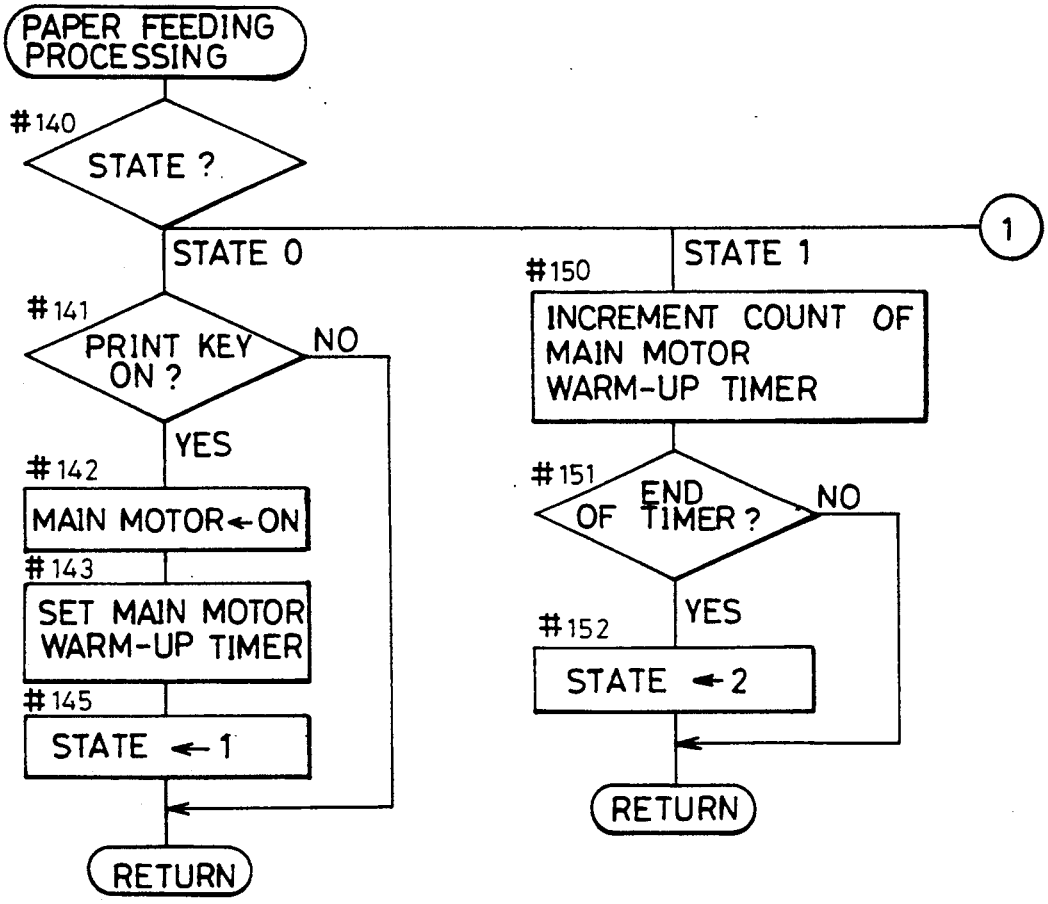
FIGS. 16A to 16F are flow charts showing specific procedures of the paper feeding processing in FIG. 4.
Figure 16B:
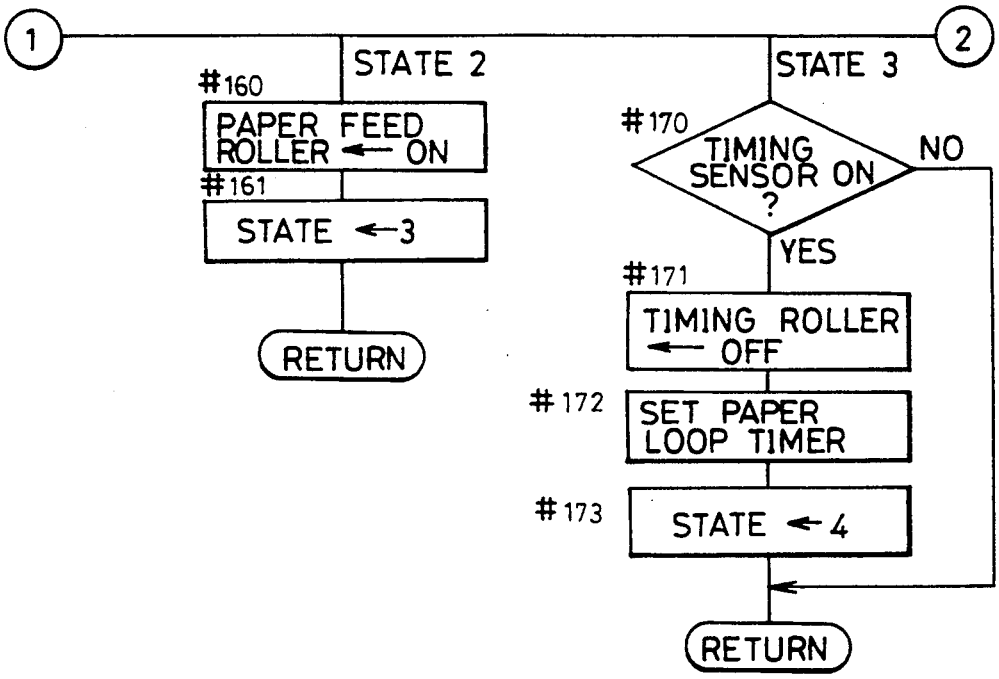
Figure 16C:
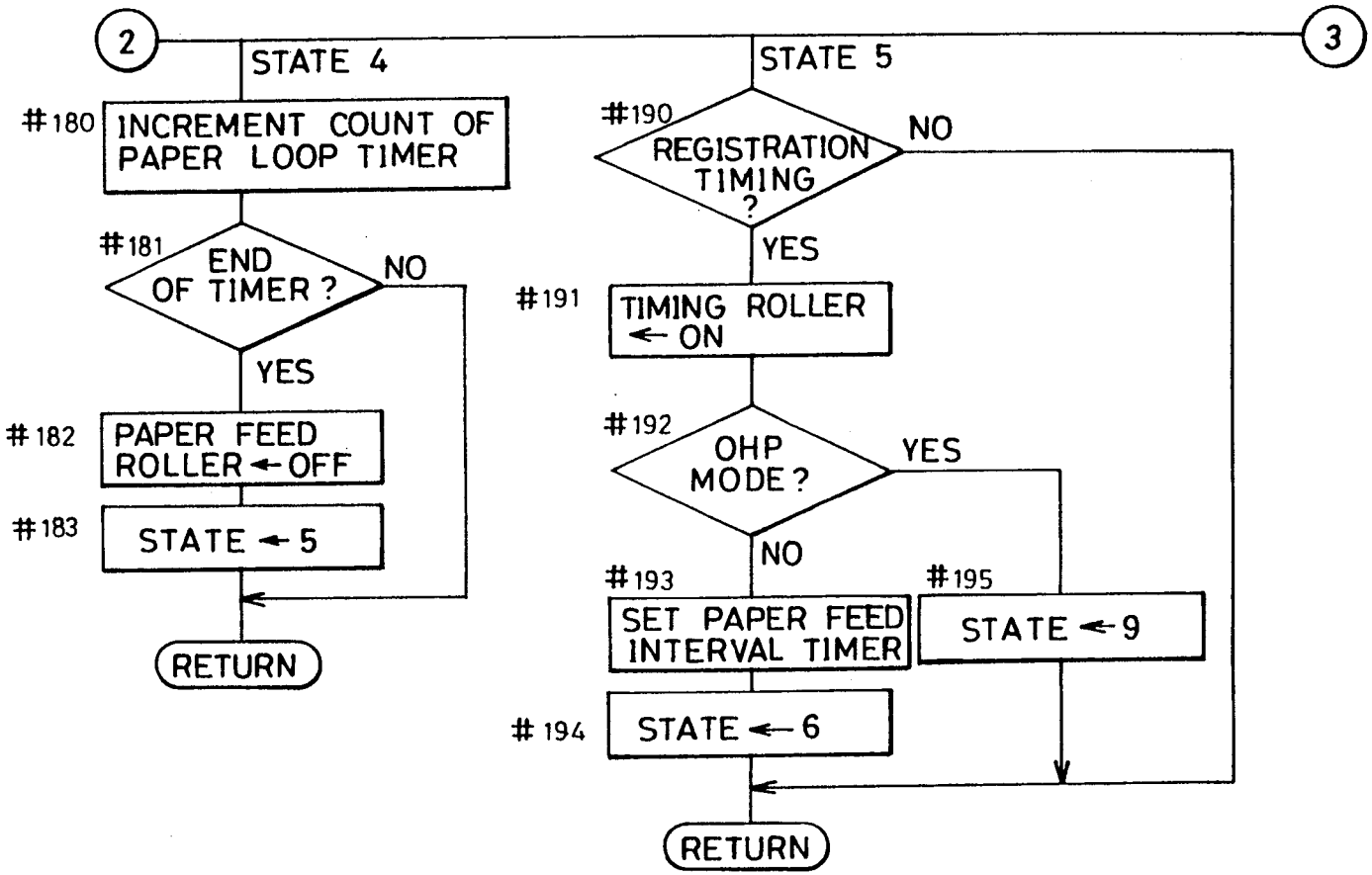
Figure 16D:
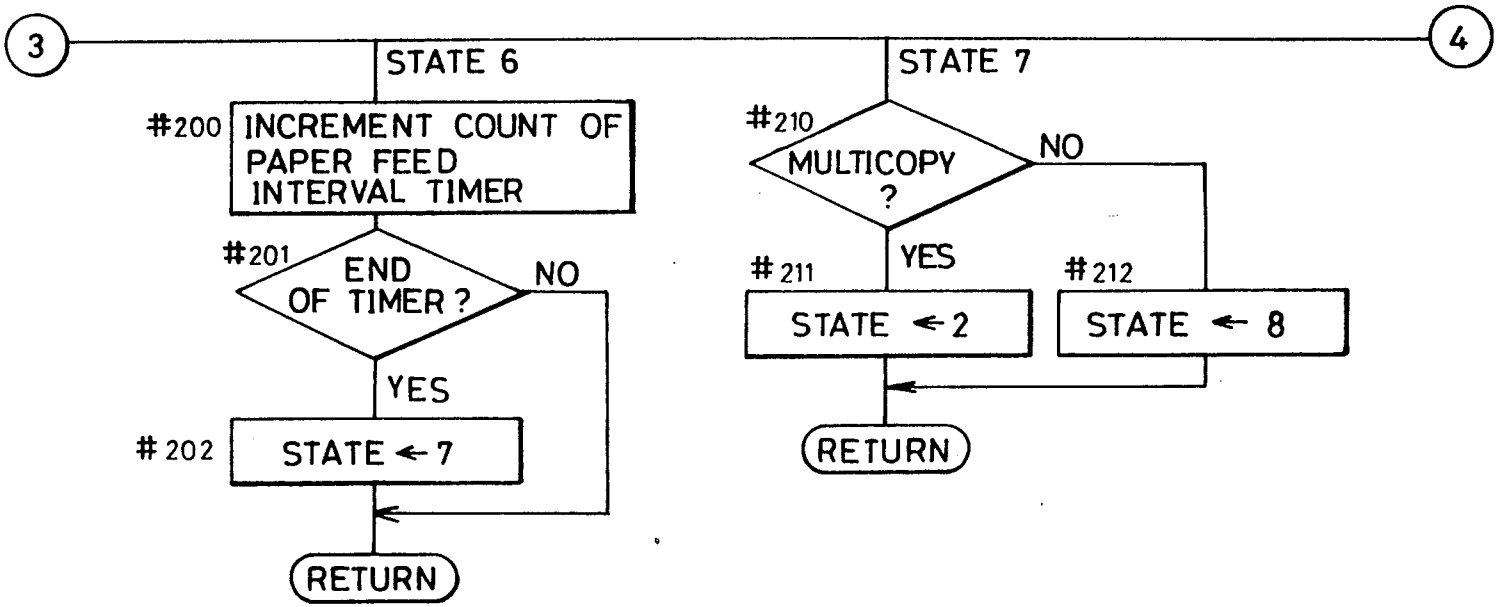
Figure 16E:
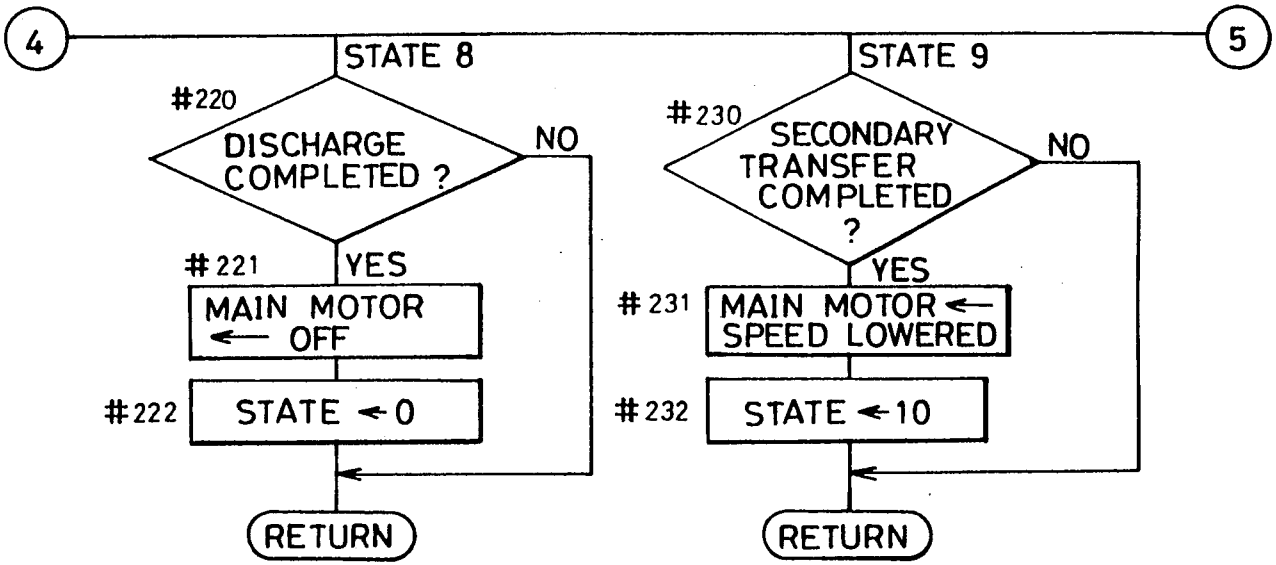
Figure 16F:
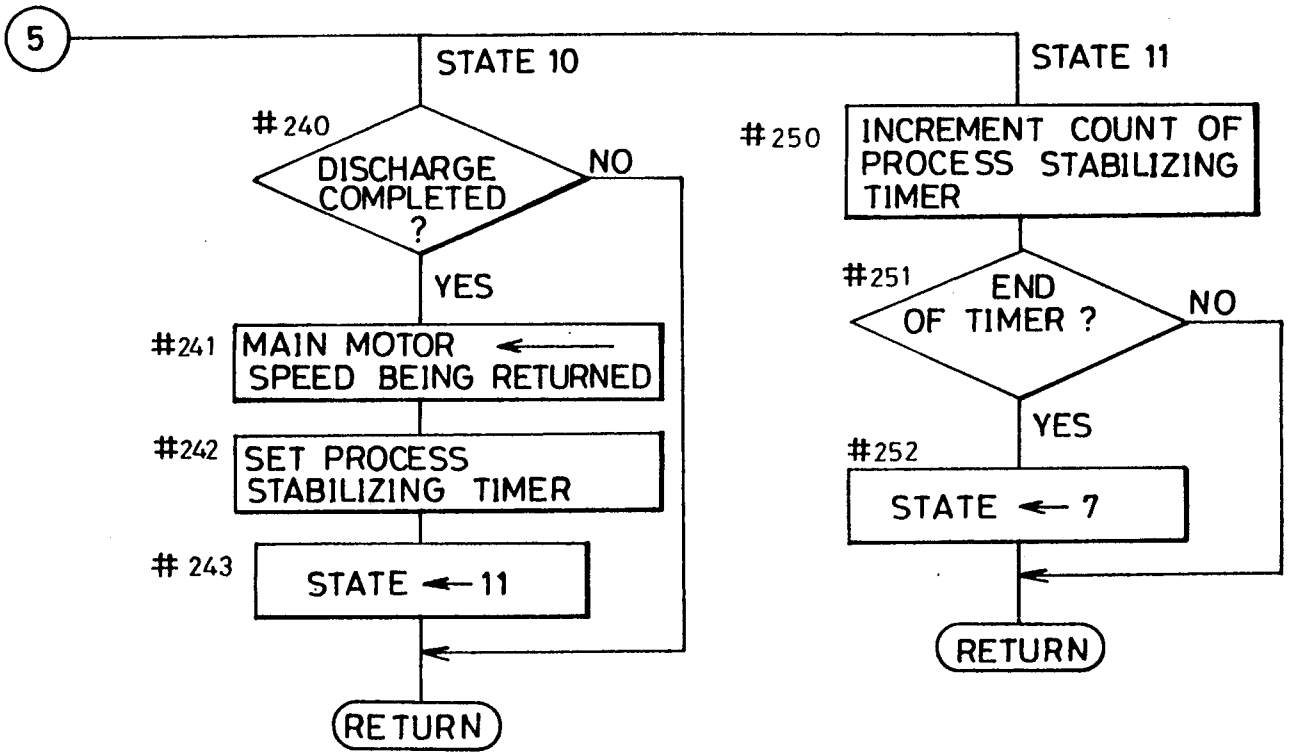
Figure 17A:
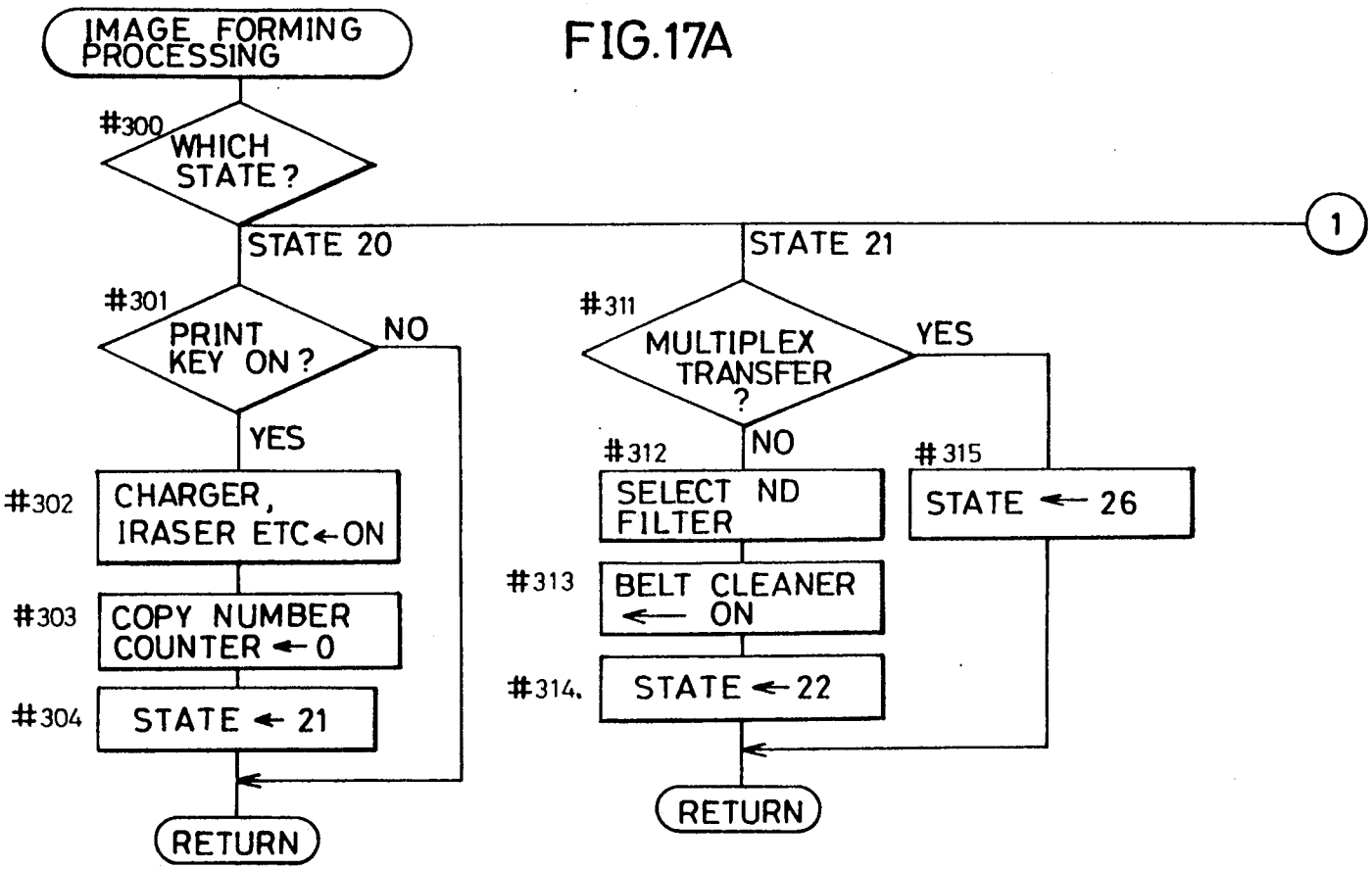
FIGS. 17A to 17H are flow chart showing specific procedures of the image forming processing in FIG. 4.
Figure 17B:
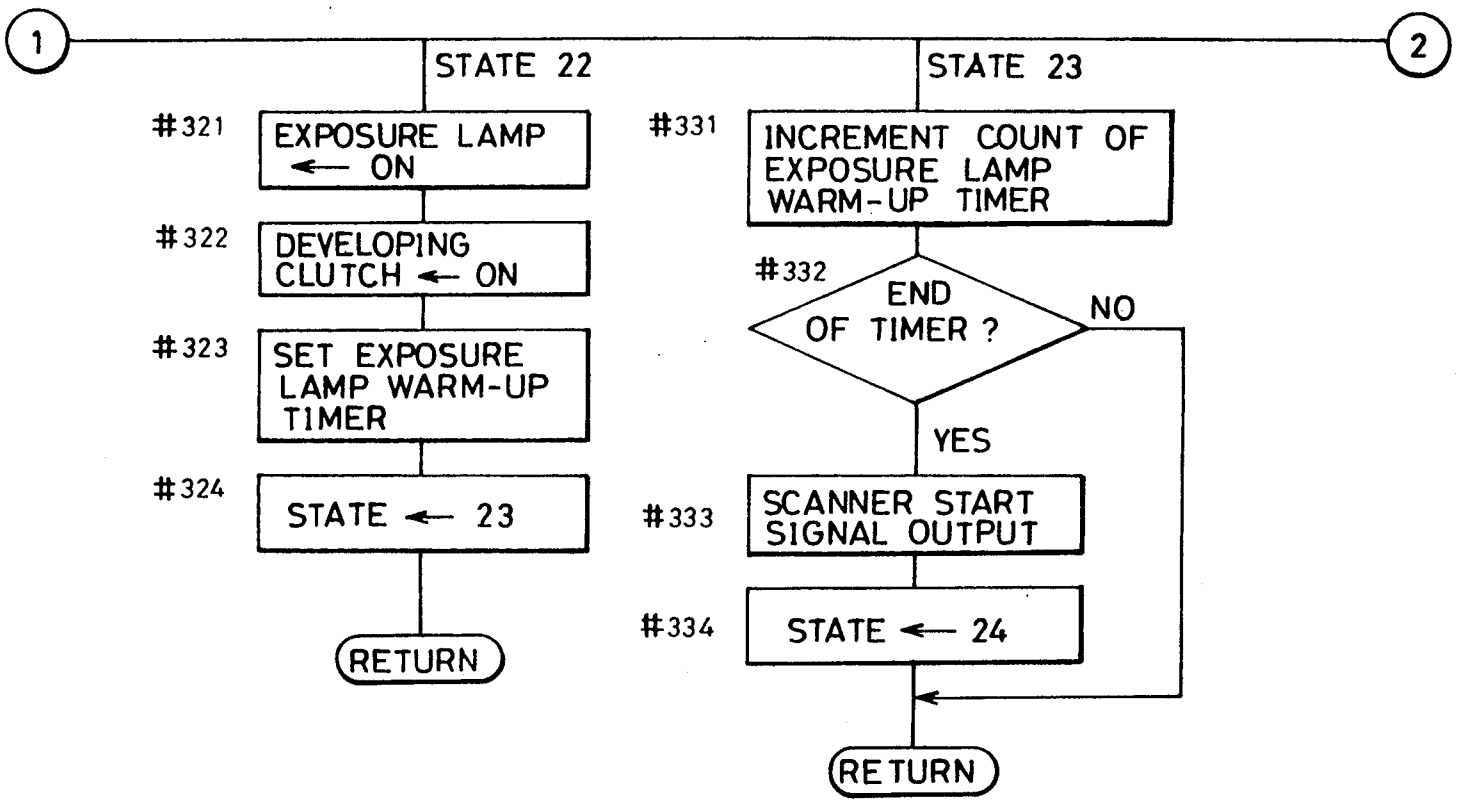
Figure 17C:
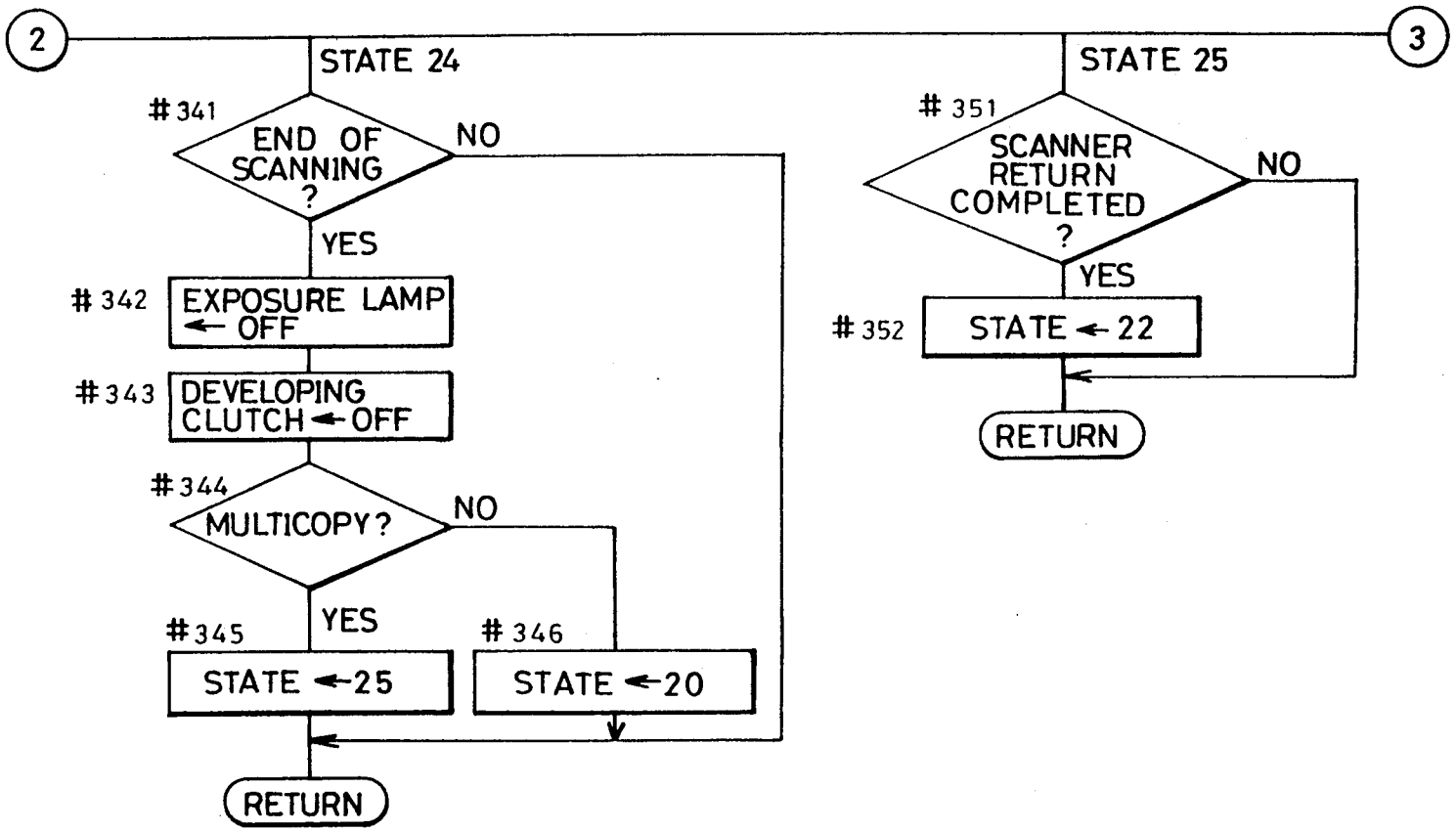
Figure 17D:
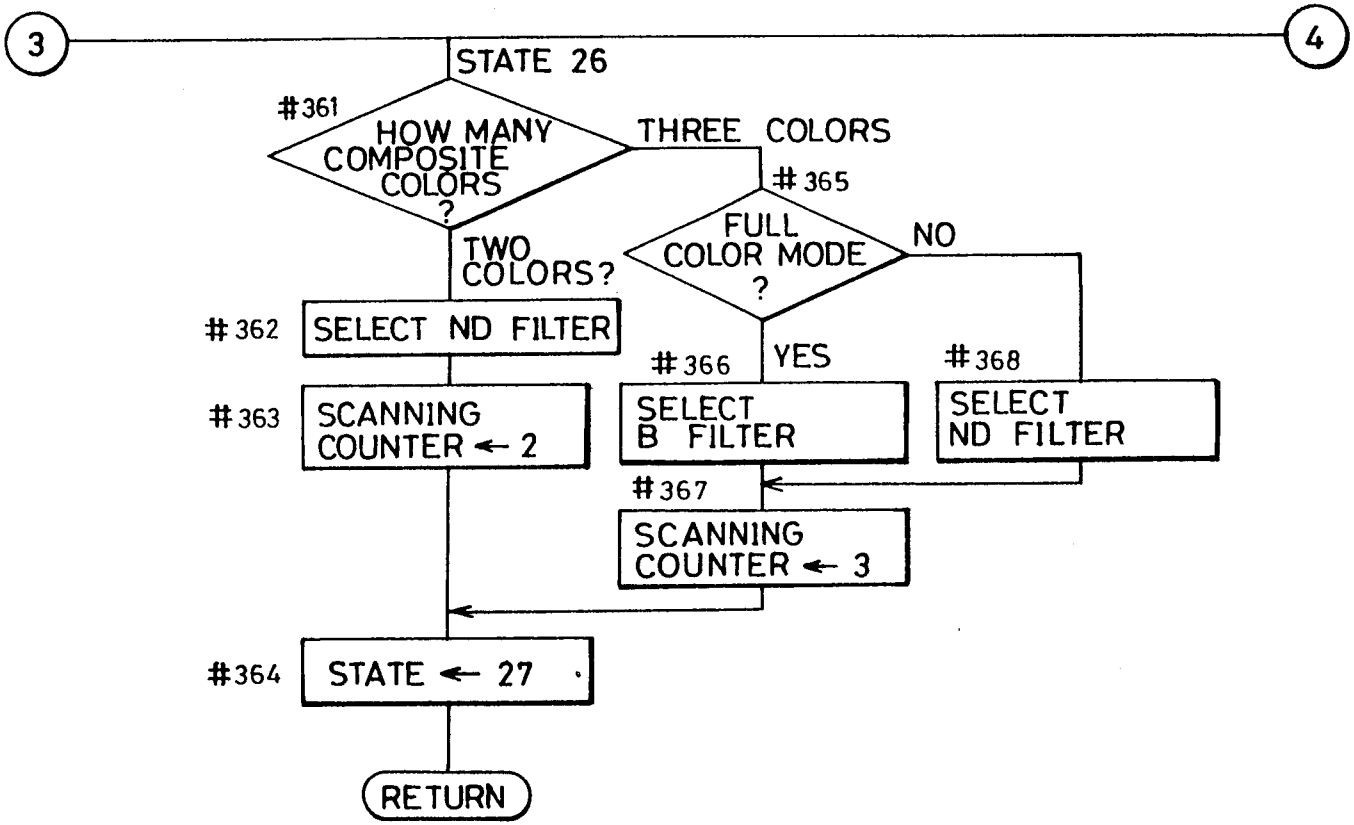
Figure 17E:
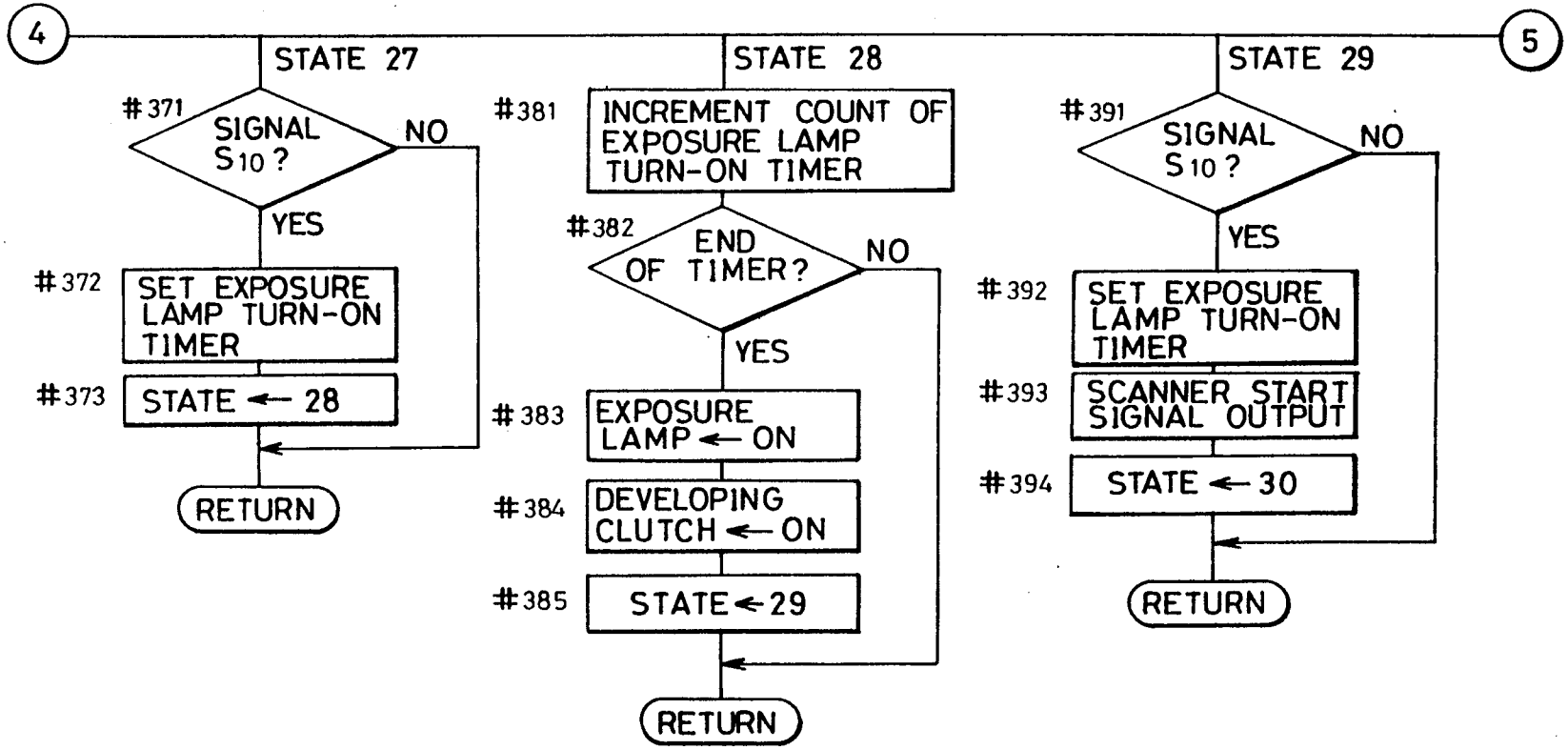
Figure 17F:
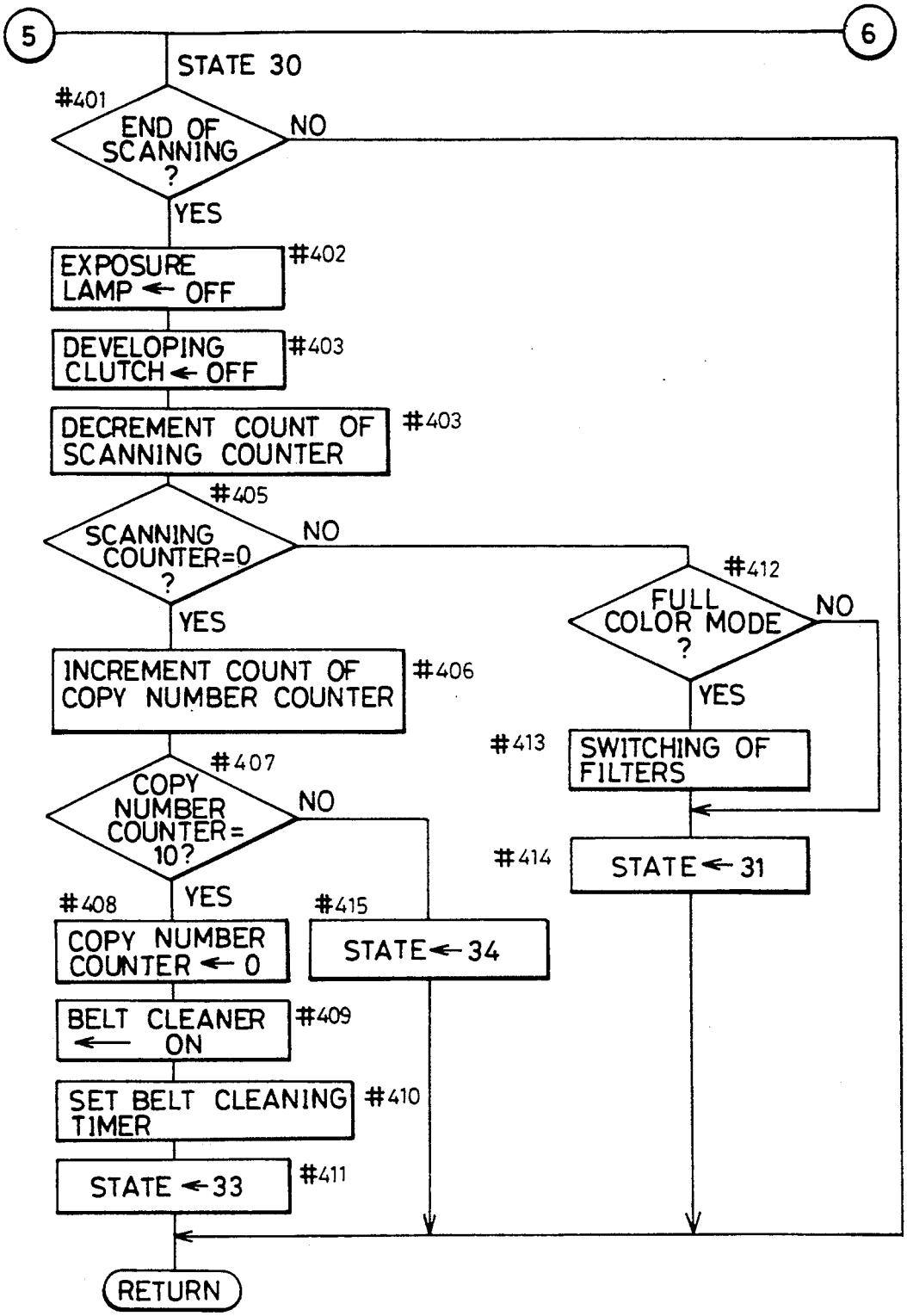
Figure 17G:
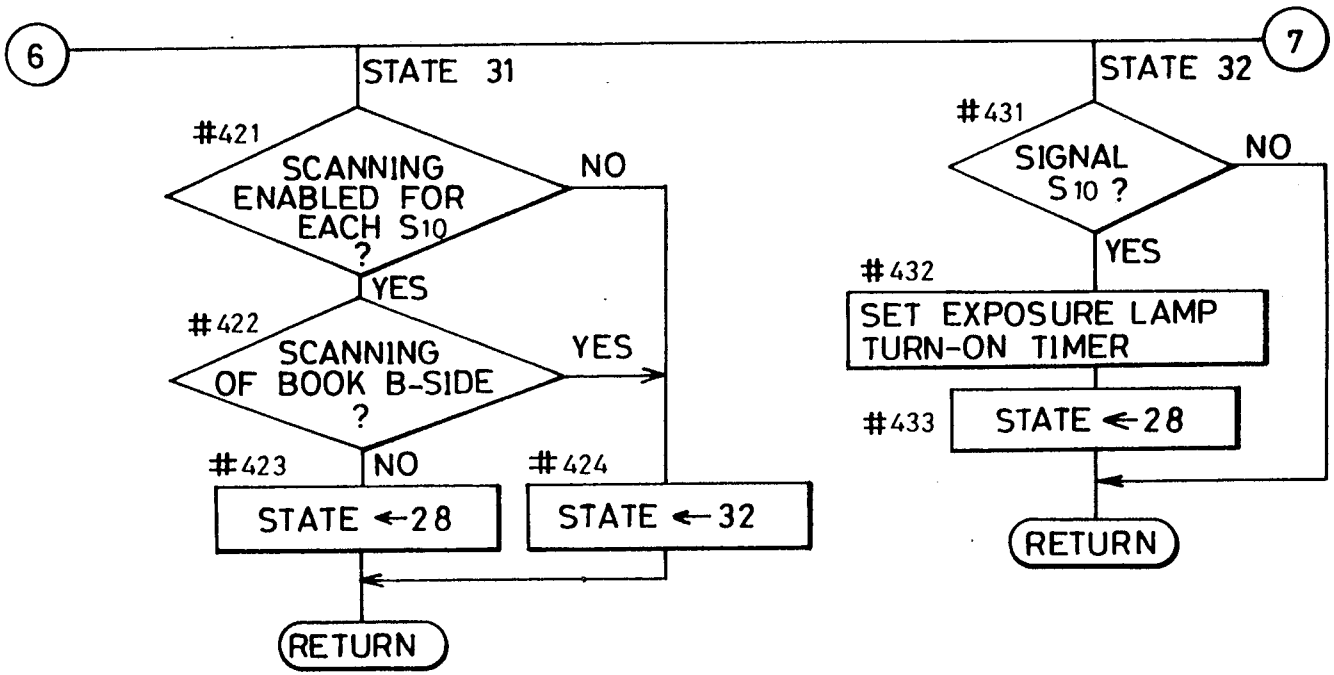
Figure 17H:
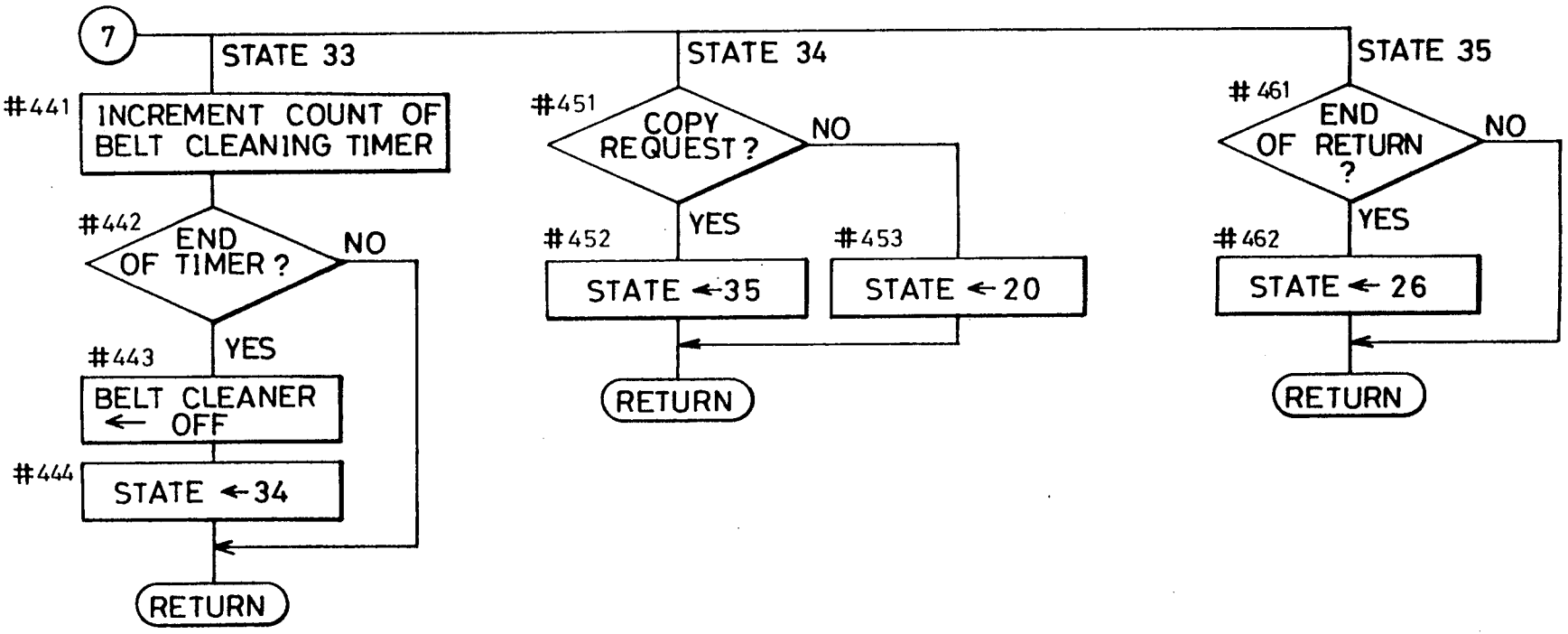

FIGS. 15A and 15B are flow charts of the color designation display processing in step #91 of FIG. 13.

In this subroutine, it is determined first in steps #120 to #125 successively whether the copy mode corresponding to the single color of Y, M, C, R, G or B is set.

If YES in steps #120 to #125, the LEDs 235 to 240 are turned on in steps #126 to #131, respectively, to display the setting of the corresponding copy mode.

If NO in all of steps #120 to #125, the program proceeds to step #132 to determine whether the full color mode is set or not. If YES in step #132, the LED 242 is turned on in step #135.

If NO in step #132, it is determined in step #133 whether the BK copy mode is set or not. If YES, the LED 241 is turned on in step #136.

If NO in step #133, it is determined in step #134 whether the three-color superposition mode is set or not. If YES, the LED 241 blinks in step #137.

If the LED 241 blinks, the operator determines whether the three-color mode is a correct mode. If it is the correct mode, the operator depresses the print key 200 to start printing. If it is not the correct mode, BK toner is newly supplied and then the operator designates again the BK mode. Thus, if BK toner is lacking in the color copying apparatus 1, the operator can makes a selection to form a black copy image by compositing the toners of the three primary colors or to form a black copy image by using the newly supplied BK toner.

FIGS. 16A to 16F are flow charts of the paper feeding processing in step #5 of FIG. 4.

In this subroutine, a state is determined by the count value of a state counter in step #140 and the following processing is performed dependent on the determined state.

The state is "0" in an initial state immediately after turn-on of the power supply and in a waiting state after an end of copy operation.

In the state "0", it is determined first in step #141 whether the print key 200 is on or not. If NO, the program returns to the main routine.

If YES in step #141, the main motor 22 is turned on in step #142 to start drive of the respective components.

Next, in step #143, a main motor warm-up timer for waiting until rotation of the main motor 22 becomes stable is set. In step #145, the state is set to "1".

In the state "1", the main motor warm-up timer counts upward in step #150. Thus, for each execution of step #150, the count value of the main motor warm-up timer is incremented and the measurement of time proceeds.

Subsequently, in step #151, it is determined whether the count value of the main motor warm-up timer attains a prescribed value, that is, whether the measurement of time is terminated. If NO, the program returns. If YES in step #151, the state is advanced to "2" in step #152.

In the state "2", the page feed roller 21 is turned on in step #160 to feed paper P into a transport path and the state is set to "3" (in step #161).

In the state "3", it is determined in step #170 whether the timing sensor 14 is on or not.

If YES in step #170, the timing roller 20 is turned off in step #171 and in step #172, a paper loop timer for superposition is set. In step #173, the state is set to "4".

In the state "4", the paper loop timer counts upward in step #180 and in step #181, it is determined whether the paper loop timer comes to end.

If YES in step #181, the paper feed roller 21 is turned off in step #182 and the state is set to "5" (in step #183).

In the state "5", it is determined in step #190 whether timing for superposition of paper P with respect to the toner image on the transfer belt 11 is selected or not.

If YES in step #190, the timing roller 20 is turned on to advance feeding of the paper P (in step #191).

Subsequently, in step #192, it is determined whether the OHP mode is selected or not. If the OHP mode is selected, it is necessary to lower the speed of transport of the paper P with respect to the fixing unit 19 and accordingly the program proceeds to step #195 to set the state to "9".

If NO in step #192, a paper feed interval timer for setting constant intervals of successive sheets of paper P in the transport path is set (in step #193) and the state is set to "6" (in step #194).

In the state "6", the count value of the paper feed interval timer is incremented in step #200 and an end of the paper feed interval timer is determined in step #201. If the page feed interval timer comes to the end, the state is set to "7" in step #202.

In the state "7", it is determined in step #210 whether multicopy with the number of copies being two or more is designated through the operation panel OP.

If multicopy is designated, the state is returned to "2" in step #211. If single copy with the number of copies being one is set, the state is advanced to "8" in step #212.

In the state "8", there is a wait until all the fed sheets of paper P are discharged onto the outlet tray 33. If completion of the discharge is determined in step #220 based on the signal from the discharge sensor, not shown, or the like, the main motor 22 is turned off in step #221 to return the state to "0" (in step #222).

If the OHP mode is determined to be selected in step #192 in the above-mentioned state "5", processing in the states "9" to "11" is performed.

In the state "9", it is determined first in step #230 by using timing of the process whether the toner image of a single color or toner images of multiple colors are secondarily transferred from the transfer belt 11 onto the paper P.

If YES in step #230, the program proceeds to step #231, in which the rotating speed of the main motor 22 driving the fixing roller 54 is lowered in order to prolong the time of passage of the paper P through the fixing unit 19 (i.e., the heating time) as mentioned above.

It is also possible to lower only the rotating speed of the fixing roller 54 by using the clutches or the like while maintaining the rotating speed of the main motor 22 at a normal speed.

After that, in step #232, the state is set to "10".

In the state "10", it is confirmed in step #240 that the paper P for the OHP having passed through the fixing unit 19 at a low speed is discharged. In step #241, the rotating speed of the main motor 22 is returned to the normal speed.

Subsequently, in step #242, a process stabilizing timer for waiting until the respective components related with the electrophotographic process are in stable state is set and the state is advanced to "11" in step #243.

In the state "11", the count value of the process stabilizing timer is incremented in step #250 and it is determined in step #251 whether the process stabilizing timer comes to an end.

If YES in step #251, the state is returned to "7" in step #252 and the program returns to the main routine.

FIGS. 17A to 17H are flow charts of the image forming processing in step #6 of FIG. 4.

First, in step #300, the state is determined and the following processing according to each of the states "20" to "35" is performed.

In the state "20", it is determined first whether the print key 200 is on or not (in step #301).

If YES in step #301, the corona charger 5, the main eraser lamp 4 and the like are turned on in step #302 so as to prepare for the electrophotographic process.

Next, in step #303, a copy number counter is set to "0" and the state is advanced to "21". The copy number counter counts the number of secondary transfers from the transfer belt 11 onto the paper P.

In the state "21", it is determined in step #311 whether a multiplex transfer mode is set or not.

If NO in step #311, that is, if a copy image is to be formed by using toner of a single color, the program proceeds to step #312.

If the multiplex transfer mode is set, it is necessary to perform scanning for a plural number of times with timing according to rotations of the transfer belt 11 and thus the state is advanced to "26" in step #315.

In step #312, the ND filter is selected by the filter selecting mechanism 28 to define the optical path for exposure.

Next, in step #313, the belt cleaner 15 is turned on to clean the transfer belt 11 and the state is advanced to "22" (in step #314).

In the state "22", the exposure lamp 24 is turned on (in step #321) and any developing clutch in the developing devices 7 to 10 is turned on according to the selected copy mode (in step #322). An exposure lamp warm-up timer for waiting until the light amount of the exposure lamp 24 becomes stable is set (in step #323) and the state is set to "23" (in step #324).

In the state "23", the count value of the exposure lamp warm-up timer is incremented in step #331 and it is determined in step #332 whether the exposure lamp warm-up timer comes to an end or not.

If YES in step #332, a scanner start signal S20 for starting forward movement of the scanner 50 is supplied in step #333 and the state is set to "24" in step #334.

In the state "24", it is determined in step #341 whether scanning is terminated or not. If YES, the exposure lamp 24 is turned off (in step #342) and the developing clutch previously turned on is turned off (in step #343).

Subsequently, in step #344, it is determined whether multicopy is selected or not. If multicopy is selected, the state is set to "25" in step #345. If single copy is selected, the state is returned to the initial value "20" in step #346.

In the state "25", it is determined in step #351 whether return of the scanner 50 is terminated or not. If the return is terminated, the state is set to "22" in step #352.

If the multiplex transfer mode is determined to be selected in step #311 in the state "21" as described above, processing in the states "26" to "35" is performed.

In the state "26", the number of colors to be composited is determined in step #361.

If two colors are to be composited in step #361, this means that the composite monochromatic (R, G or B) copy mode is selected. Accordingly, the ND filter is selected (in step #362) and "2" is set in a scanning counter indicating the number of scanning operations with respect to one sheet of a copy image (in step #363). Then, the state is advanced to "27" (in step #364).

If it is determined in step #361 that three colors are to be composited, the program proceeds to step #365 to determine whether the full color mode is selected or not.

If the full color mode is selected, the B filter is selected to form a toner image of Y at first (in step #366). If the full color mode is not selected, that is, the three-color superposition mode is selected, the ND filter is selected (in step #368).

After execution of step #366 or #368, "3" is set in the scanning counter and the state is advanced.

In the state "27", it is determined in step #371 whether the rotating position signal S10 is generated or not, that is, whether the belt mark 57 on the transfer belt 11 is detected or not. If YES in step #371, an exposure lamp turn-on timer for defining timing for turn-on of the exposure lamp 24 is set and the state is advanced to "28" (in step #373).

Thus, the transfer belt 11 is driven at the constant speed and the cycle of generation of the rotating position signal S10 is constantly fixed. Thus, the color copying apparatus 1 uses the exposure lamp turn-on timer to turn on the exposure lamp 24 taking account of prescribed time with reference to the timing of generation of the preceding rotating position signal S10 before start of scanning so that the light amount of the exposure lamp is stable in scanning started with reference to the timing of generation of the next rotating position signal S10. Thus, it is possible to prevent wasteful illumination of the exposure lamp 24 and scanning in an unstable light amount.

In the state "28", the count value of the exposure lamp turn-on timer is incremented in step #381 and it is determined in step #382 whether the exposure lamp turn-on timer comes to an end or not.

If YES in step #382, the exposure lamp 24 is turned on (in step #383) and the developing clutch is turned on (in step #384). Then, the state is advanced to "29" (in step #385).

In the state "29", it is determined in step #391 whether the rotating position signal S10 is generated or not.

If YES in step #391, the exposure lamp turn-on timer is set in step #392 to define the timing for turn-on of the exposure lamp 24 for scanning of the second and subsequent colors in the same manner as described above. In step #393, a scanner start signal S20 is supplied. After that, the state is advanced to "30" (in step #394).

In the state "30", it is determined first in step #401 whether the scanning is terminated or not.

If the scanning is terminated, processing in the subsequent steps #402 to #415 is performed.

More specifically, the exposure lamp 24 is turned off (in step #402), the driven developing clutch is turned off (in step #403), and the count value of the scanning counter is decremented (in step #404). After that, it is determined whether the value of the scanning counter is "0" or not (in step #405).

If YES in step #405, which means that copy operation for one sheet of paper P is terminated, the count value of the copy number counter is incremented in step #406.

Subsequently, in step #407, it is determined whether the value of the copy number counter attains 10 or not. If NO, the program proceeds to step #415 to advance the state to "34".

If YES in step #407, the copy number counter is reset (in step #408), and the belt cleaner 15 is turned on (in step #409). A belt cleaning timer for measuring cleaning time (substantially equal to time for one rotation of the transfer belt 11) is set (in step #410). After that, the state is advanced to "33" in step #411.

More specifically, if multicopy is designated and the multiplex transfer mode, such as the full color mode, the copy mode of each composite color (R, G, B) or the three-color superposition mode is selected, a toner image corresponding to each of a plurality of sheets of paper P is formed in the same position on the transfer belt 11. Consequently, even if a small amount of toner remains on the transfer belt 11 after secondary transfer, it exerts little effect on the subsequent sheet of paper P and it is not necessary to clean the transfer belt 11 for each sheet of paper P. However, if remaining toner is accumulated, it might lower the quality of the copy image. Therefore, in the copying apparatus 1, the copy number counter counts the number of secondary transfers and the electrophotographic process is interrupted for ten sheets of paper P so that the transfer belt 11 is cleaned.

If NO in the above-mentioned step #405, the program proceeds to step #412 to determine whether the full color mode is selected or not.

If the full color mode is not selected, the state is advanced to "31" in step #414. If the full color mode is selected, switching of filters is effected in step #413 to select the G filter or the R filter according to the color of the toner image to be formed subsequently and then the program proceeds to step #414.

In the state "31", a scanning table TS to be described afterwards concerning paper sizes and copying magnifications is referred to in step #421 so that it is determined whether scanning is enabled for each generation of the rotating position signal S10.

If YES in step #421, it is determined whether the next scanning is scanning on a book B-side in order to determine whether scanning for each generation of the rotating position signal S10 is enabled or not in the book mode.

The book B-side is a side more distant from the home position of the scanner 50 in the case where the original D is divided into two areas using, as a boundary, the center of the scanning course (M5) on the original glass platen 31. The nearer side is a book A-side. In the book mode, the book A-side and the book B-side are copied on separate sheets of paper P.

If NO in step #422, the state is returned to "28" in step #423 and there is a wait for the next turn-on of the exposure lamp 24.

If NO in step #421 and YES in step #422, the state is advanced to "32" in step #424.

In the state "32", it is determined in step #431 whether the rotating position signal S10 is generated or not.

If YES in step #431, the exposure lamp turn-on timer is set in step #432 and the state is returned to "28" in the subsequent step #433 without supplying the scanning start signal S20 as is different from the above-mentioned state "29".

In this case, the rotating position signal S10 is rendered ineffective with respect to start of scanning.

FIG. 19 is a diagram showing contents of the scanning table TS.

The scanning table TS stores data of the number of generations of the rotating position signals S10 ("1" or "2") as a necessary condition for start of scanning, based on a result of calculation of the forward and returning (backward) movement time of the scanner 50 defined by the relationships between the size and feeding direction of paper P on the glass platen 31 and the copying magnification set by means of the ten-key pads 202 or the like.

In indications of paper sizes in this figure, "A3 length" for example represents a case of feeding paper P of A3 size along its longitudinal direction as the feeding direction, and "A4 width" represents a case of feeding paper P of A4 size with its longitudinal direction being perpendicular to the feeding direction.

In the color copying apparatus 1, the length of the transfer belt 11 is 450 mm and the processing speed in the normal operation mode is 110 mm/sec.

Consequently, the time for one rotation of the transfer belt 11 (i.e., the cycle of generation of one rotating position signal S10) is 4.09 seconds.

As for the scanner 50, the time required for forward and returning movement including periods of acceleration, constant speed, and deceleration is for example 3.0 seconds (2.2 seconds for forward movement and 0.8 seconds for returning movement) in the case of equal-magnification copy using A4 width paper P. In this case, the time required for the movement is shorter than the cycle of generation of the signal S10 and accordingly scanning can be started consecutively for each generation of the signal S10 (i.e., for each rotation of the transfer belt 11).

On the other hand, in the case of equal-magnification copy using A3 length paper P, the time required for forward and returning movement of the scanner 50 is 5.4 seconds (4.2 seconds for forward movement and 1.2 seconds for returning movement) and since the time for the movement is longer than the cycle of generation of the signal S10, scanning cannot be started consecutively for each generation of the signal S10. Consequently, the generated signals S10 are alternately rendered ineffective as described above so that scanning can be started for two generated signals S10.

In addition, even in the case of using the paper P of the same size, the time for forward and returning movement differs dependent on the copying magnification.

More specifically, the scanning table TS has the data on the number of generations of the rotating position signals S10 ("1" or "2") used as the condition for start of scanning, predetermined in relation to the copy conditions including the size and feeding direction of paper P on the glass platen 31 and the copying magnification set by means of the ten-key pads 202 or the like.

Referring again to FIG. 17, in the state "33", the count value of the belt cleaning timer is incremented in step #441 and it is determined in step #442 whether the belt cleaning timer comes to an end or not.

If YES in step #442, the belt cleaner 15 is turned off in step #443 to terminate the cleaning of the transfer belt 11 started in the above-mentioned step #409.

After that, in step #444, the state is advanced to "34".

In the state "34", it is determined in step #451 whether a copy request for subsequent copy operation is issued or not. If the copy request is not issued, the program proceeds to step #453 to return the state to the initial value "20". Thus, the color copying apparatus 1 is in a waiting state.

If the copy request is issued, the state is advanced to "35" in step #452.

In the state "35", it is determined in step #461 whether the return of the scanner 50 is terminated or not.

If YES in step #461, the state is returned to "26" in step #462 to proceed to the subsequent copy operation.

Figure 18A:
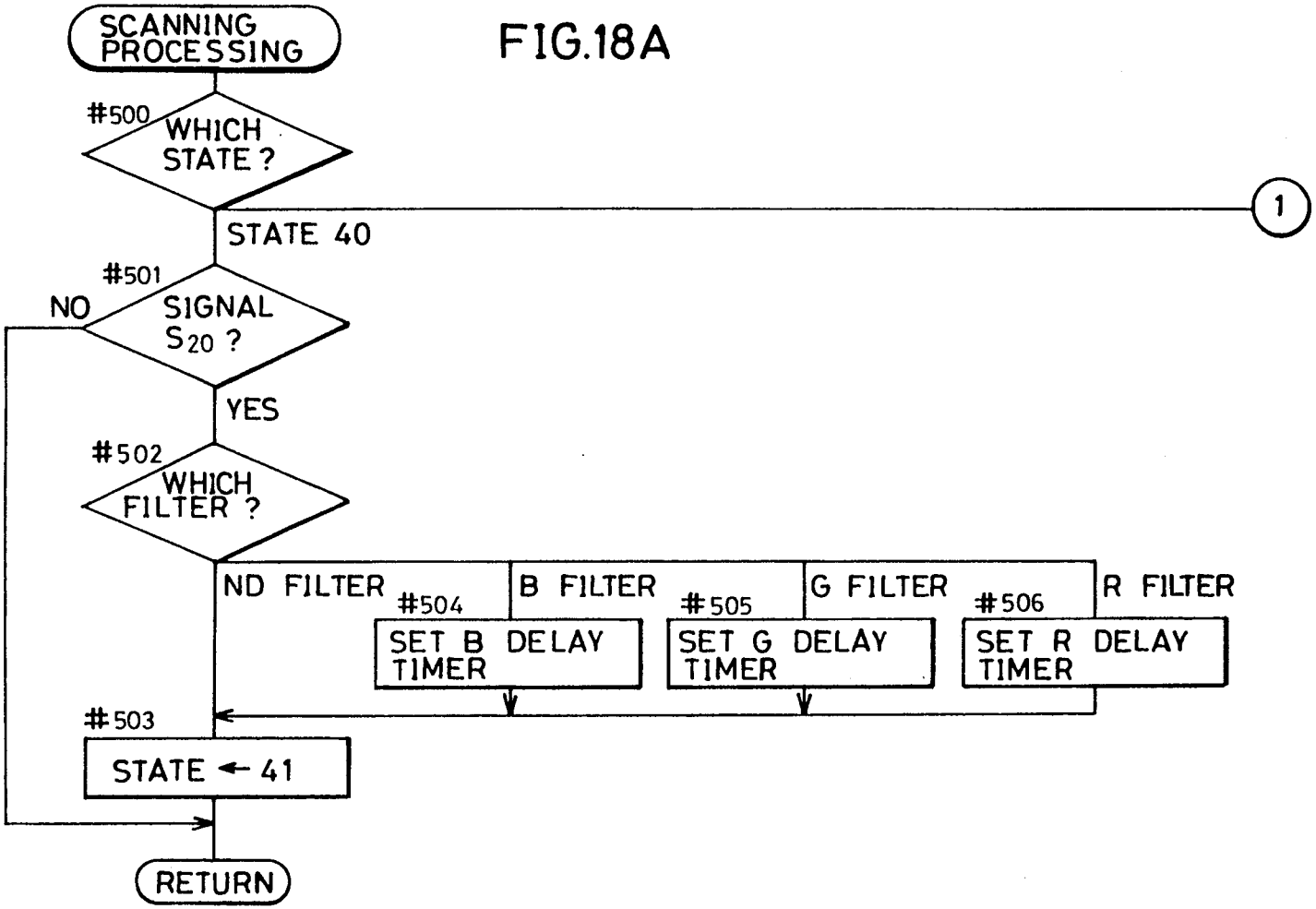
FIGS. 18A and 18B are flow charts showing specific procedures of the scanning processing in FIG. 4.
Figure 18B:
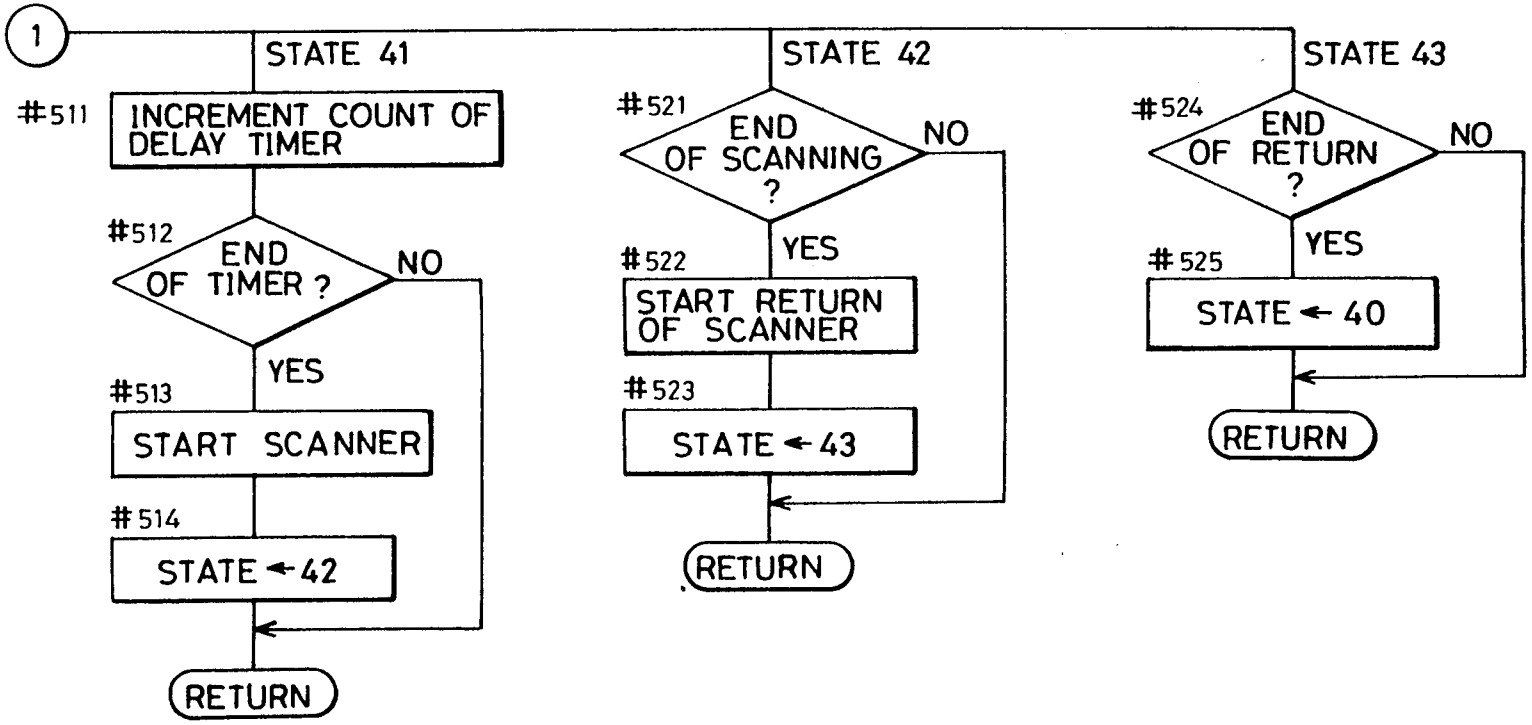

FIGS. 18A and 18B are flow charts of the scanning processing in step #7 of FIG. 4.

First, in step #500, the state is determined and the following processing is executed according to each of the states "40" to "43".

In the state "40", it is first determined in step #501 whether the scanner start signal S20 is supplied or not. If YES, the program proceeds to step #502.

In step #502, the filter selected corresponding to the color of the toner in the optical system 40 is determined and the processing branches in the below described manner according to the determined filter.

If the ND filter is selected, the program proceeds to step #503, in which the state is advanced to "41" and then the program returns.

If the B filter is selected, a B delay timer where measurement time is defined is set in step #504 based on the timing correction by the dip switch 455, prior to renewal of the state.

If the G filter is selected, or if the R filter is selected, the program proceeds to step #505 or #506 to set a G delay timer or an R delay timer with defined measurement time by using the dip switch 456 or 466. Then, the state is renewed.

In the state "41", the count value of the set delay timer is incremented in step #511 and it is determined in step #512 whether the delay timer comes to an end or not.

If YES in step #512, forward movement of the scanner is started by the scanning motor 70 in step #513 and the state is set to "42".

In step #512, although the delay timer is not set if 50 the ND filter is selected, it is determined that the timer comes to an end, that is, the condition is met.

In the state "42", it is determined in step #521 whether the scanner 50 in the forward movement reaches the trailing edge of the original D to terminate scanning.

If the scanning is terminated, return of the scanner 50 is started in step #522 and the state is advanced to "43" (in step #523).

In the state "43", there is a wait for return of the scanner 50 to the home position and when termination of the return is determined in step #524, the state is returned to the initial value "40" in step #525.

According to the above-described embodiment, operation in the electrophotographic process is forbidden until an elapse of predetermined time enabling the respective components to be stable at the time of switching from the OHP mode for enhancing light transmittance of a copy image to the normal copy mode Thus, it is possible to form a copy image of high quality with constantly stable process conditions.

The above-described embodiment shows by way of example the color copying apparatus 1 of the intermediate transfer system including the transfer belt 11 as the intermediate transfer medium between the photoreceptor drum 2 and the paper P to superpose toner images of respective colors on the transfer belt 11. However, the present invention is also applicable to color copying apparatus using as a system of superposition of toner images, a system for superposition on copy paper wound on a rotating unit such as a transfer drum, or a system for superposition on a photoreceptor drum (for example as disclosed in Japanese Patent Laying-Open No. 61-32854).

According to the present invention, it is possible to provide a color copying apparatus having a small size and a low cost, and capable of forming a color copy image of high quality without any deviation in superposition of toner images of respective colors.

In addition, according to the present invention, it is possible to provide a color copying apparatus in which the number of copies of a monochromatic copy image per unit time can be increased.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A color copying apparatus comprising:

scanning means for scanning an original and forming a plurality of electrostatic latent images corresponding to color components of an image of the original, said scanning means executing a predetermined number of scanning operations for one original, each scanning operation corresponding to each color component, developing means for converting the plurality of electrostatic latent images formed by said scanning means to toner images of different colors, a rotating unit on which said converted toner images are superposed, detecting means for detecting a rotating position of said rotating unit, control means responsive to a detection output of said detecting means for controlling start timing of said scanning means, said control means including timing means for defining a suitable scan starting timing for each color component, and adjusting means for adjusting said timing means, whereby each of said scan start timings are independently adjusted.

2. A color copying apparatus comprising:

scanning means for scanning an original and forming a plurality of electrostatic latent images corresponding to color components of an image of the original, developing means for converting the plurality of electrostatic latent images formed by said scanning means to toner images of different colors, a rotating unit on which said converted toner images are superposed, detecting means for detecting a rotating position of said rotating unit, control means responsive to a detection output of said detecting means for controlling start timing of said scanning means, regulating means for regulating said start timing for each of said toner images, and said scanning means including color filters corresponding to the respective colors of said toner images, said scanning means also includes mirrors for guiding scanning light of the original to said photoreceptor corresponding to said color filters and each said mirror and the corresponding one of said color filters are integrally formed, and scans the original for a plural number of times to expose a receptor through each of said color filters selected for each scanning.

3. The color copying apparatus in accordance with claim 2, wherein said detecting means generates a detection output for one rotation of said rotating unit.

4. The color copying apparatus in accordance with claim 1, wherein said developing means includes developing devices containing toners of primary colors of cyan, magenta and yellow.

5. The color copying apparatus in accordance with claim 4, wherein said developing means further includes a developing device containing black toner.

6. The copying apparatus comprising:

scanning means, including illumination means for illuminating an original, for scanning the same original for a plural number of times while illuminating the same original by said illumination means and forming a plurality of electrostatic latent images corresponding to color components of an image of the original, said scanning means includes a scanner moving forward and backward for scanning the original, and an exposure lamp for illuminating the original, said control means includes exposure lamp control means for turning on said exposure lamp to illuminate the original with a prescribed light amount at the time of forward movement of said scanning means, and turning off said exposure lamp at an end of forward movement of said scanner and prior to said scanner's return to a home position, developing means for converting said electrostatic latent images formed by said scanning means to toner images of different colors, a rotating unit on which said toner images are superposed, detecting means for detecting a rotating position of said rotating unit, and control means responsive to a detection output of said detecting means for controlling timing of turn-on of said illumination means, in each of second and subsequent scanning operations with respect to the same original, said control means being responsive to the detection output of said detecting means corresponding to the preceding scanning operation.

7. The color copying apparatus in accordance with claim 6, wherein said detecting means generates the detection output for one rotation of said rotating unit.

* * * * *